US011600948B2

(12) United States Patent
Nakamura et al.

(10) Patent No.: US 11,600,948 B2
(45) Date of Patent: Mar. 7, 2023

(54) CONNECTOR

(71) Applicant: Yazaki Corporation, Tokyo (JP)

(72) Inventors: Masatoshi Nakamura, Shizuoka (JP); Jun Ishikawa, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 113 days.

(21) Appl. No.: 17/398,457

(22) Filed: Aug. 10, 2021

(65) Prior Publication Data

US 2022/0052484 A1 Feb. 17, 2022

(30) Foreign Application Priority Data

Aug. 11, 2020 (JP) ..... JP2020-135568

(51) Int. Cl.
*H01R 13/631* (2006.01)
*H01R 13/627* (2006.01)

(52) U.S. Cl.
CPC ..... *H01R 13/631* (2013.01); *H01R 13/6272* (2013.01)

(58) Field of Classification Search
CPC ..... H01R 13/631; H01R 13/6272; H01R 13/639; H01R 13/641; H01R 13/645; H01R 13/502
See application file for complete search history.

(56) References Cited

U.S. PATENT DOCUMENTS

| | | | | |
|---|---|---|---|---|
| 5,507,666 | A * | 4/1996 | Yamanashi | H01R 13/641 439/354 |
| 5,947,763 | A * | 9/1999 | Alaksin | H01R 13/641 439/352 |
| 7,470,138 | B1 * | 12/2008 | Chen | H01R 13/639 439/352 |
| 9,876,313 | B2 * | 1/2018 | Endo | H01R 13/639 |
| 9,893,464 | B2 * | 2/2018 | Endo | H01R 13/639 |
| 11,342,708 | B2 * | 5/2022 | Menez | H01R 13/6272 |
| 2009/0023325 | A1 * | 1/2009 | Chen | H01R 13/506 439/352 |
| 2020/0412052 | A1 * | 12/2020 | Menez | H01R 13/642 |
| 2022/0052484 | A1 * | 2/2022 | Nakamura | H01R 13/631 |

FOREIGN PATENT DOCUMENTS

JP 2019-003878 A 1/2019

* cited by examiner

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A connector includes a housing fitted into or detached from a mating housing, and a fitting detection member assembled to a member housing section of the housing and detecting a fitting completion. The fitting detection member includes a locked portion locked to or detached from a lock section of a flexible lock arm, and a flexible arm section provided with a slip-off prevention locking section locked to or detached from a locking protrusion of the member housing section, and when fitting of both the housings is released, the flexible arm section is bent and deformed in a direction in which a locking margin between the locking protrusion of the member housing section and the slip-off prevention locking section of the flexible arm section increases.

5 Claims, 23 Drawing Sheets

CONNECTOR

CROSS REFERENCE TO RELATED APPLICATION

The present application is based on, and claims priority from the prior Japanese Patent Application No. 2020-135568 filed on Aug. 11, 2020, the entire contents of which are incorporated herein by reference.

TECHNICAL FIELD

The present application relates to a connector provided with a CPA (fitting detection member).

BACKGROUND

Japanese Patent Application Laid-Open No. 2019-3878 discloses a connector including a connector housing, and a fitting detection member which comes in contact with a contacted section of the connector housing before being fitted into a mating connector, and after being fitted into the mating connector, detects fitting by releasing the contact with the contacted section using the mating connector and further entering therein.

SUMMARY

However, in the above connector, when the mating connector is detached from the connector housing (release of fitting), a locking margin of the protrusion of the fitting detection member does not increase, so that a holding force generated from locking of the fitting detection member and the connector housing is insufficient. As a result, there is a concern that the fitting detection member may come off.

An object of the present application is to provide a connector capable of preventing a fitting detection member from coming off from a member housing section of a housing at the time of release of fitting by increasing a locking margin between a locking protrusion of the member housing section of the housing and a slip-off prevention locking section of a flexible arm section of the fitting detection member.

A connector according to an embodiment of the present application is provided with a mating housing including a locked section, a housing fitted into or detached from the mating housing, and a fitting detection member assembled to the mating housing and movable between a temporary locked position and a regular locked position when the mating housing and the housing are fitted. The housing includes a member housing section configured to house the fitting detection member, a lock section locked to or detached from a locked section of the mating housing, and a flexible lock arm having locking release sections each of which is configured to slide along an inclined section of the fitting detection member and to release a locked state of the lock section and the locked section, the fitting detection member includes the locked portion locked to or detached from the lock section of the flexible lock arm, and a flexible arm section provided with a slip-off prevention locking section locked to or detached from a locking protrusion of the member housing section, and when fitting of the mating housing and the housing is released, the flexible arm section is bent and deformed in a direction in which a locking margin between the locking protrusion of the member housing section and the slip-off prevention locking section of the flexible arm section increases.

The connector may be configured such that a state in which the locked portion of the flexible arm section of the fitting detection member is brought into contact with the lock section of the flexible lock arm by assembling the fitting detection member to the housing is a temporary locked state of the fitting detection member, the flexible arm section of the fitting detection member and the flexible, lock arm are bent and deformed by the locked section of the mating housing to release the temporary locked state of the fitting detection member due to the contact between the lock section of the flexible lock arm and the locked portion of the flexible arm section of the fitting detection member, and the locked portion of the flexible arm section is locked to a locking hole of the lock section of the flexible lock arm, thereby bringing the fitting detection member into a regular locked state which is a proper fitting state of both the housings.

The connector may be configured such that in a regular locked position of the fitting detection member, a step section configured to control a displacement of the flexible lock arm is provided on a root side of the flexible arm section from a position of the slip-off prevention locking section on an upper side of the flexible arm section.

The connector may be configured such that in a regular locked position of the fitting detection member, the step section of the flexible arm section enters under a portion of an operation section provided at a distal end portion of the flexible lock arm and comes in contact therewith, thereby controlling a displacement of the flexible lock arm.

The connector may be configured such that the fitting detection member includes an operation section as a main body, side sections provided on both end sides of the operation section and the flexible arm section provided between the side sections, the locked portion is provided at a distal end of the flexible arm section, an inclined surface serving as the inclined section is provided at a root side of the flexible arm section of a protrusion wall section formed on each inner surface side of the side sections, and a rail section, which is inserted into a groove section formed in a member housing section of the housing, protrudes from each outer surface of the side sections along a sliding direction.

With the above configuration, it is possible to provide a connector capable of preventing a fitting detection member from coming off from a member housing section of a housing at the time of release of fitting by increasing a locking margin between a locking protrusion of the member housing section of the housing and a slip-off prevention locking section of a flexible arm section of the fitting detection member.

BRIEF DESCRIPTION OFTHE DRAWINGS

DETAILED DESCRIPTION

A connector according to an embodiment of the present application will be described in detail below with reference to the drawings.

Figure 1:
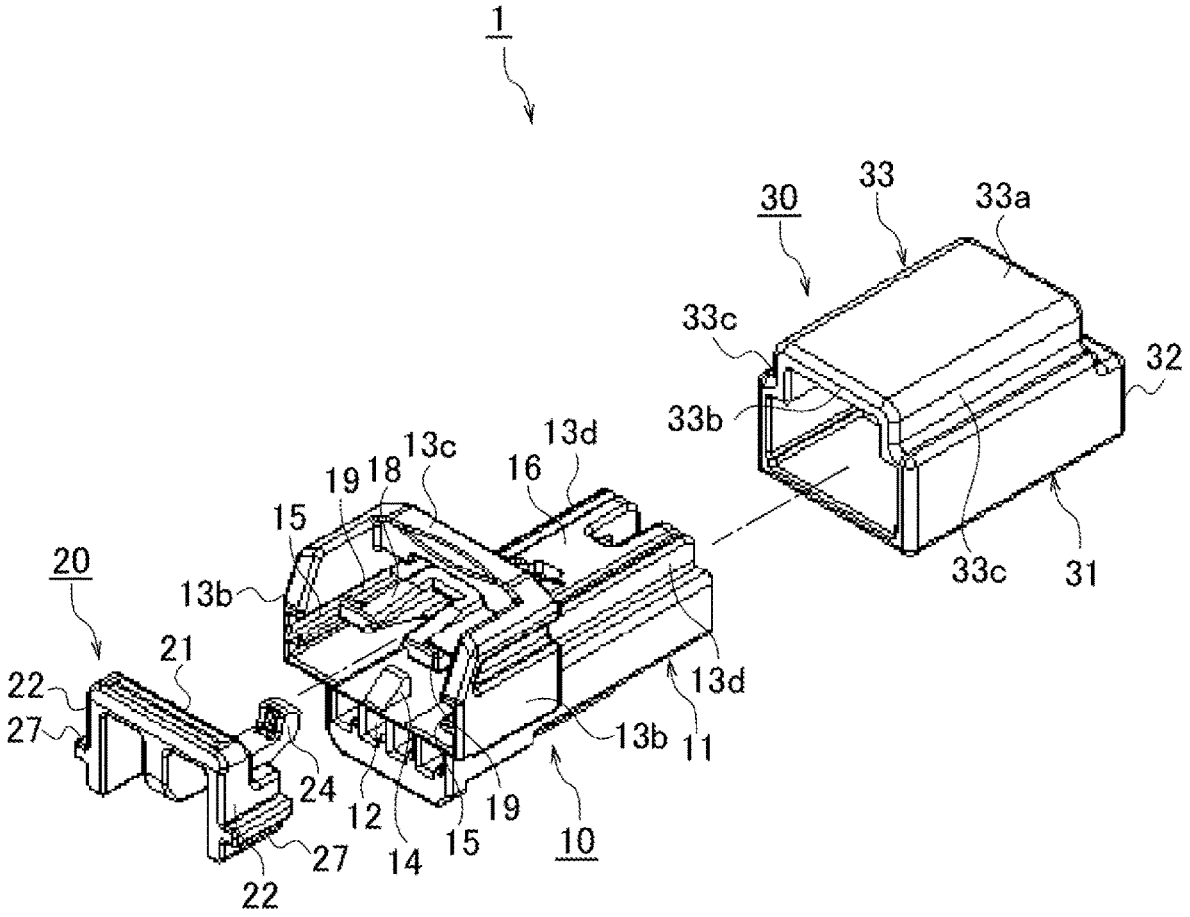
FIG. 1 is an exploded perspective view showing an example of a connector according to a first embodiment of the present application.
Figure 17:
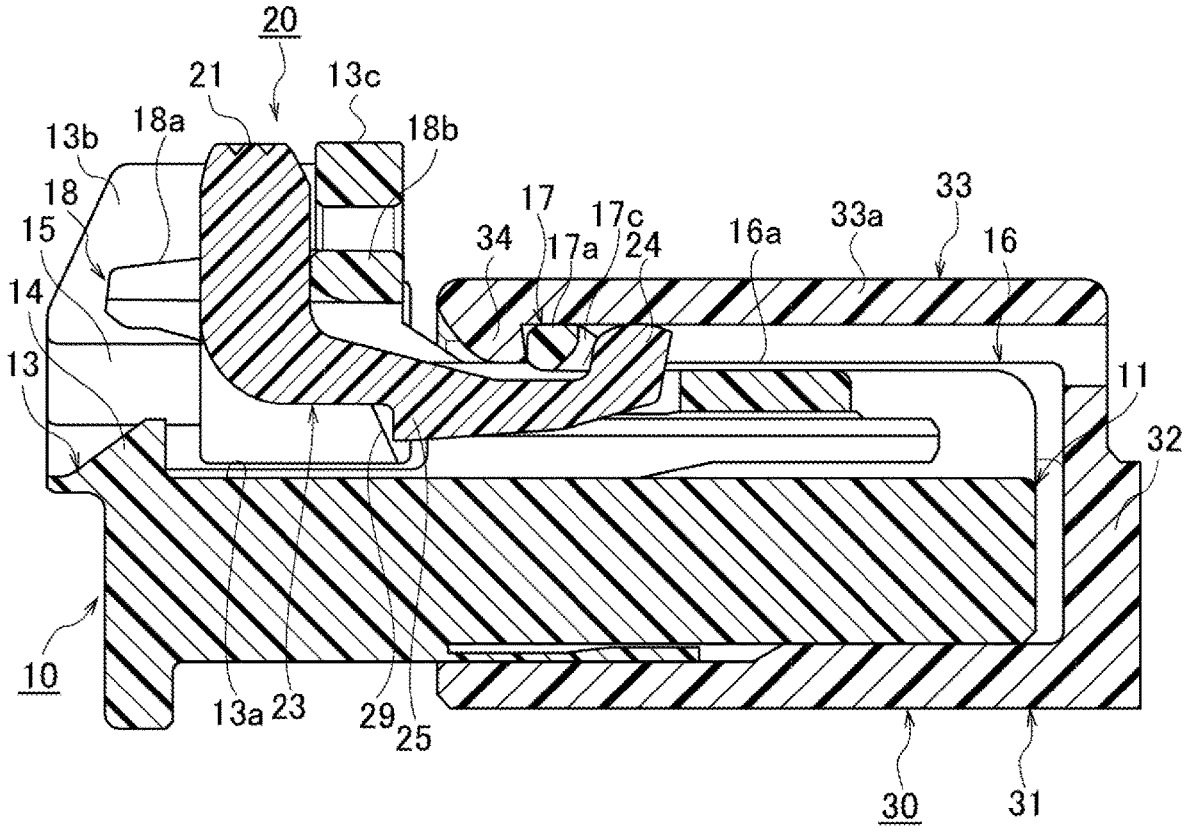
FIG. 17 is a sectional view taken along the Y-Y line in FIG. 14 showing a regular locked state of the fitting detection member.
Figure 18:
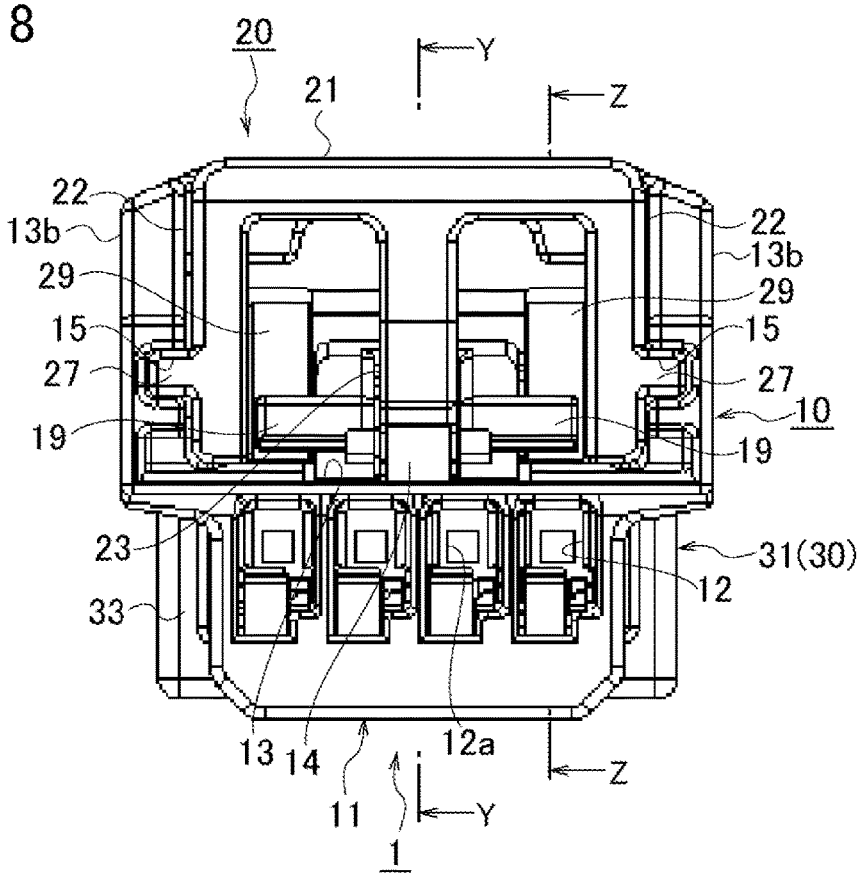
FIG. 18 is a front view of the connector before release of fitting of the female connector.

As shown in FIGS. 1 and 17, a connector 1 includes a female connector 10 having a female housing (housing) 11 made of a synthetic resin, and a male connector 30 having a male housing (mating housing) 31, which is made of a synthetic resin, into which the female housing 11 is inserted and fitted.

As shown in FIG. 17, the female connector 10 includes a fitting detection member (CPA: connector position assurance) 20, which is assembled to a CPA housing section 13 of the female housing 11, and which is made of a synthetic resin, for detecting a fitting state of both the male and female housings 11 and 31.

Figure 2A:
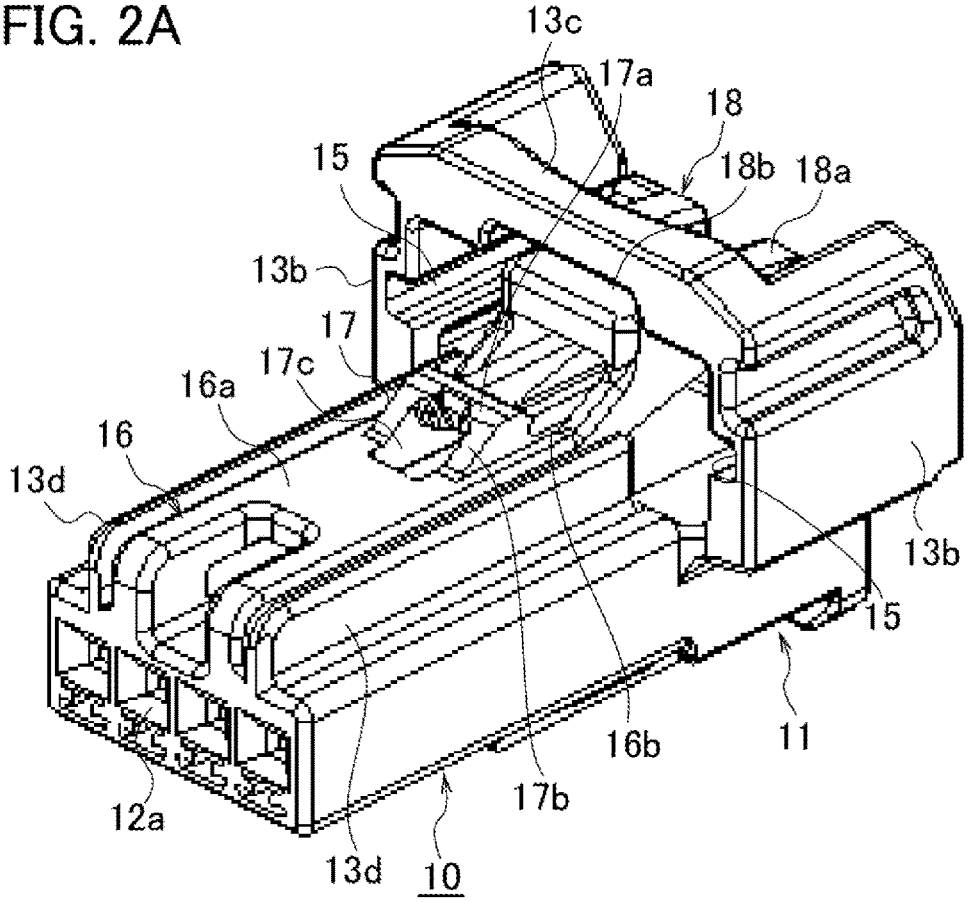
FIG. 2A is a perspective view of a female connector of the connector as viewed from the rear side.
Figure 2B:
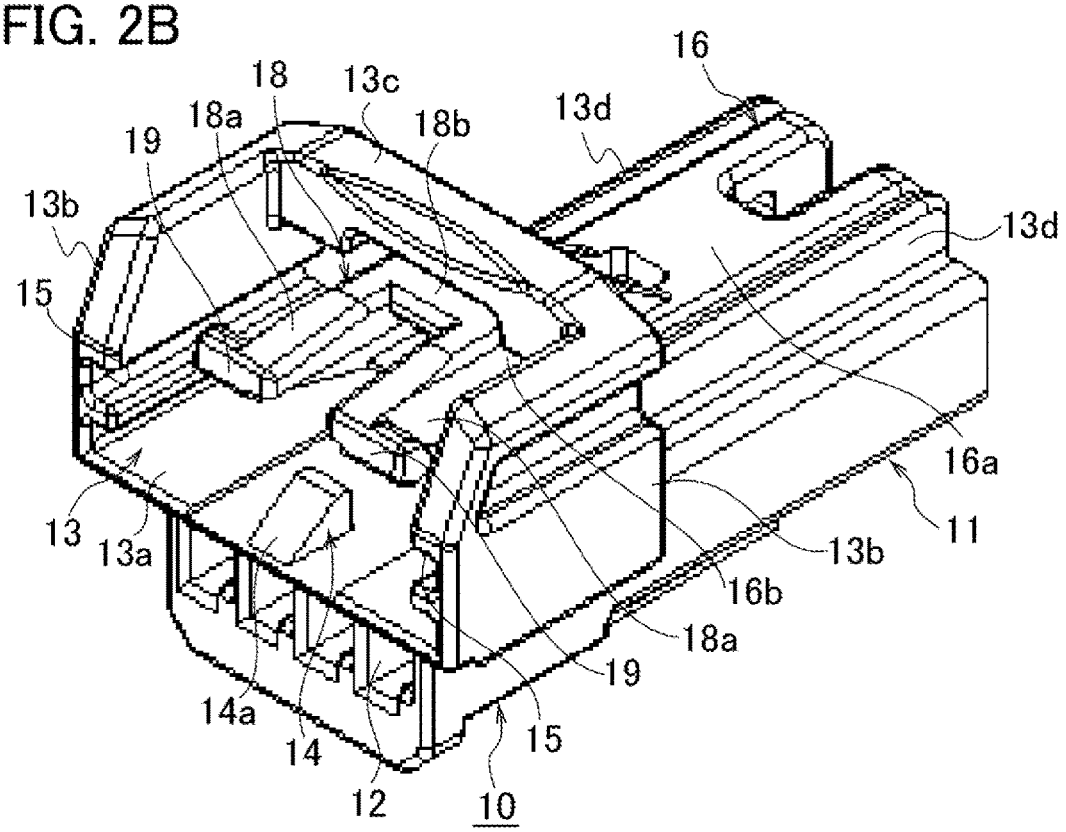
FIG. 2B is a perspective view of the female connector as viewed from the front side.

As shown in FIGS. 2A and 2B, the female housing 11 includes a plurality of terminal housing chambers 12 (four chambers in this embodiment) in which female terminals (not shown) are housed on the lower stage. The female housing 11 includes a CPA housing section (member housing section) 13 for housing the fitting detection member 20 on the front side of the upper stage. The CPA housing section 13 serves as a slide space for the fitting detection member 20. The female housing 11 includes a flexible lock arm 16 extending from the rear side of the upper stage to the front side of the CPA housing section 13.

As shown in FIGS. 2A and 2B, the CPA housing section 13 includes a bottom wall 13*a*, a pair of protection walls (both side walls) 13*b* and 13*b* extending vertically from both end sides of the bottom wall 13*a*, and a protective plate section 13*c* extending between the rear sides of the upper ends of the protection walls 13*b* and 13*b*. On the front side of the center of the bottom wall 13*a*, there is provided a locking protrusion 14 having an inclined front surface 14*a* which is locked to or detached from a slip-off prevention locking section 25 of a flexible arm section 23 of the fitting detection member 20 which will described later. A recessed groove section 15 is provided at each central inner side of the pair of protection walls 13*b* and 13*b* facing each other so as to extend to the sliding direction of the fitting detection member 20.

As shown in FIGS. 2A and 2B, the flexible lock arm 16 includes a lock protrusion (lock section) 17 which is locked to or detached from a locking protrusion (locked section) 34 of the male housing 31 at an intermediate section 16*a*, and an operation section 18 which can be manually operated at a distal end portion 16*b*. As shown in FIGS. 2A and 17, the lock protrusion 17 includes a locking section 17*a* which is locked to or detached from the locking protrusion 34, an inclined section 17*b*, and a locking hole 17*c* which is locked to or detached from a locking protrusion (locked portion) 24 of the fitting detection member 20 which will be described later.

Further, as shown in FIG. 2B, the operation section 18 includes protrusion pieces 18*a* and 18*a*, the proximal end sides of which protrude from a distal end portion 16*b* of the lock arm 16 and the front sides of which are bifurcated. The bifurcated protrusion pieces 18*a* and 18*a* are disposed in the CPA housing section 13 of the female housing 11. The operation section 18 includes a pair of boss sections (locking release sections) 19 which protrude outward from each of the protrusion pieces 18*a* and 18*a* and slide along an inclined surface (inclined section) 29 of the fitting detection member 20 which will be described later. As shown in FIG. 17, in a regular locked position of the fitting detection member 20, a step section 26 of an arm section 23 enters under a central section 18*b* of the operation section 18, which protrudes in a bridge shape, and comes in contact therewith, thereby controlling the displacement of the lock arm 16.

As shown in FIGS. 2A and 2B, the intermediate section 16*a* of the flexible lock arm 16 is positioned between a pair of side walls 13*d* and 13*d* formed integrally protruding onto the terminal housing chamber 12 of the female housing 11. The operation section 18 provided at the distal end portion 16*b* of the flexible lock arm 16 is disposed between the pair of protection walls 13*b* and 13*b* of the CPA housing section 13. The sliding movement of the fitting detection member 20 pushes the lock arm 16 downward through the operation section 18, so that the lock arm 16 can be bent downward and deformed. That is, as shown in FIGS. 19 to 21B, when fitting of the male housing 31 and the female housing 11 is released, the distal end portion 16*b* side of the lock arm 16 can be bent downward and deformed by the sliding movement of the fitting detection member 20. In addition, the distal end portion 16*b* side of the lock arm 16 can be bent downward and deformed even by manually pressing the operation section 18 downward.

As shown in FIGS. 13 to 17, the fitting detection member 20 is assembled to the CPA housing section 13 of the female housing 11, and slides in the regular locking direction R which is the regular locked position from the temporary locked position, thereby detecting the fitting state of the male and female housings 11 and 31. That is, as shown in FIGS. 3 to 5, the fitting detection member 20 includes an operation section 21 as a main body, side sections 22 and 22 provided on both end sides of the operation section 21, and a flexible arm section 23 protruding from the center of a lower surface 21*a* of the operation section 21 so as to extend to the front side in a substantially L-shaped cross section.

Figure 13:
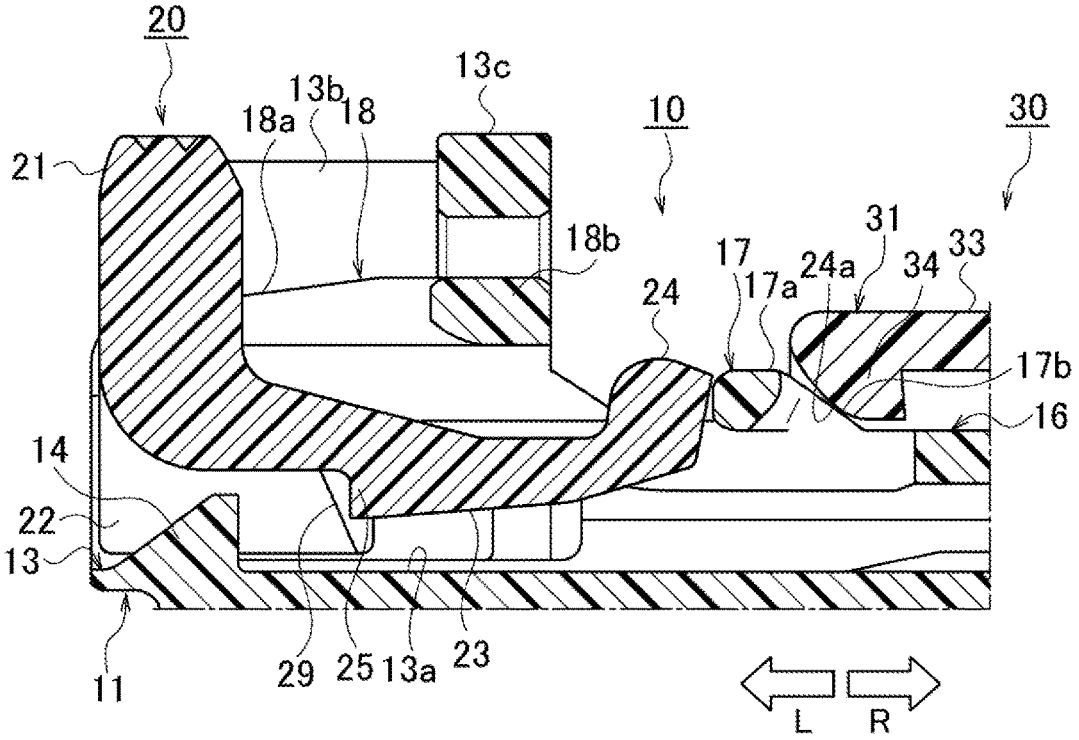
FIG. 13 is a partial sectional view taken along the Y-Y line in FIG. 8 showing a temporary locked state of the fitting detection member.
Figure 14:
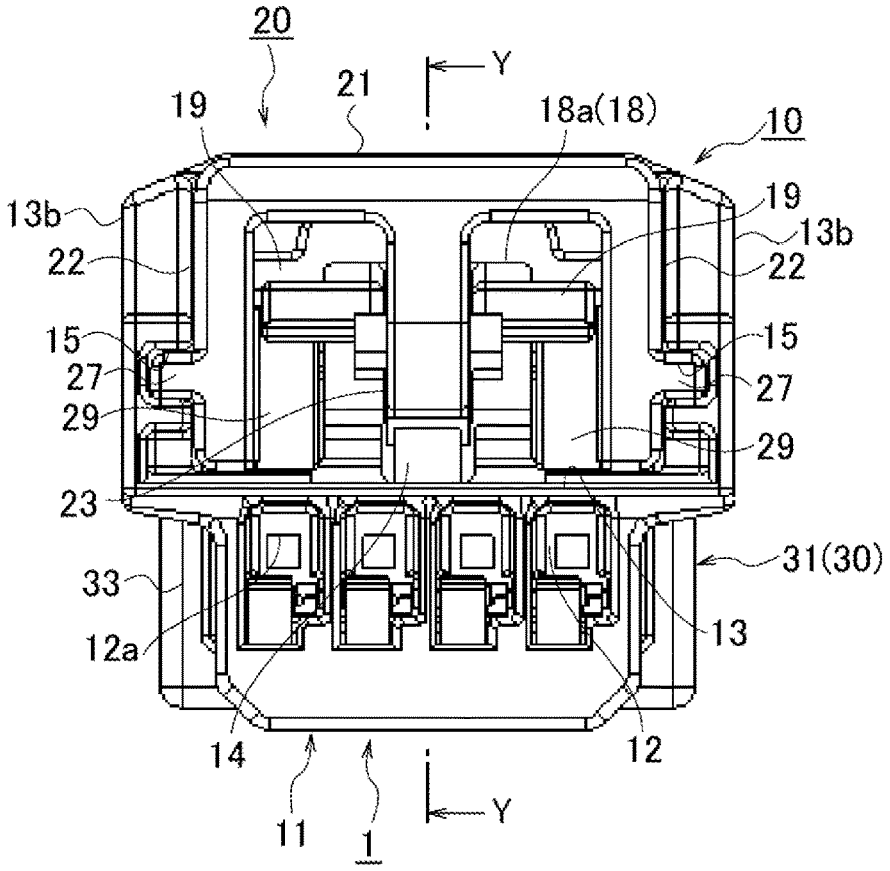
FIG. 14 is a front view of the connector before fitting of the female connector.
Figure 15:
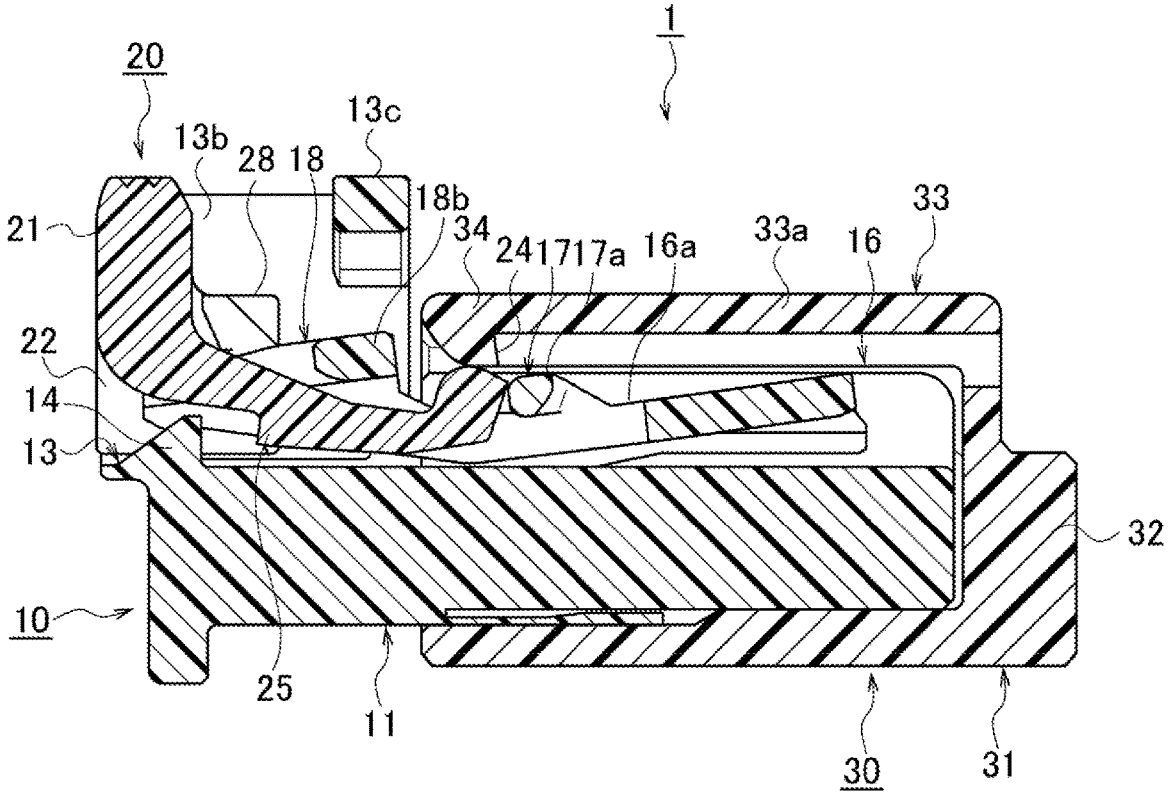
FIG. 15 is a sectional view taken along Y-Y line in FIG. 14 showing a halfway state of fitting of the female connector.
Figure 16:
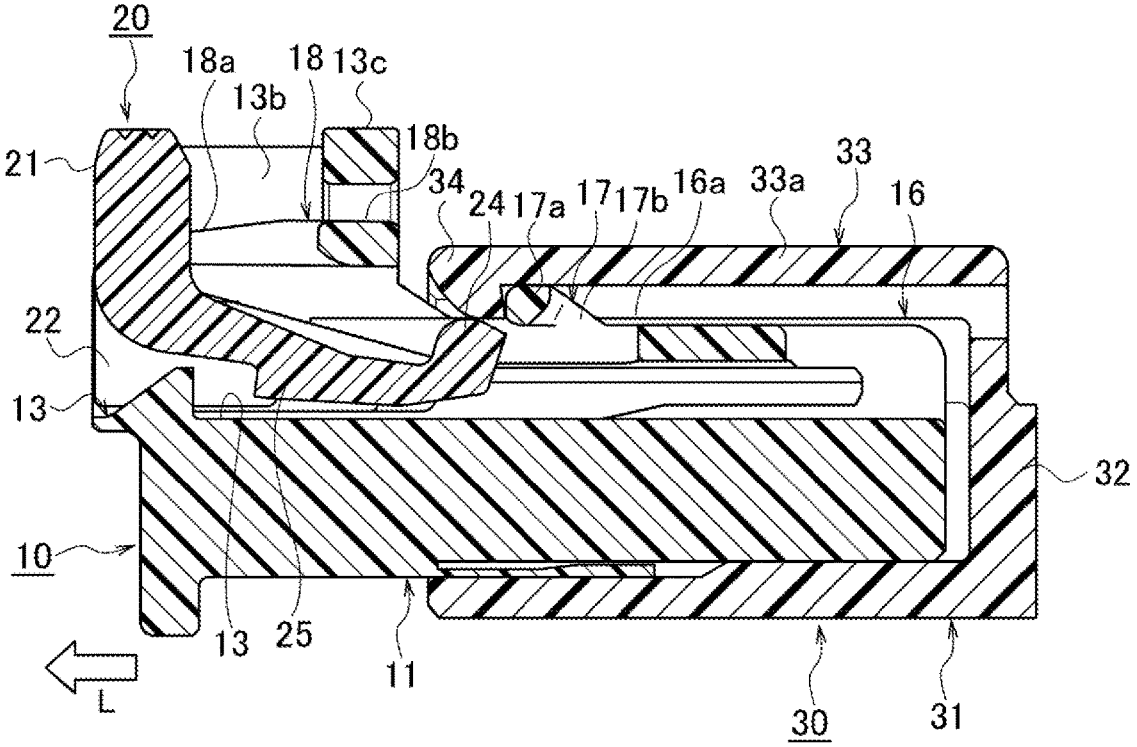
FIG. 16 is a sectional view taken along the Y-Y line in FIG. 14 showing a state of completion of fitting of the female connector.

As shown in FIG. 13, the operation section 21 of the fitting detection member 20 covers the operation section 18 of the flexible lock arm 16 in the temporary locked position of the fitting detection member 20. Further, as shown in FIG. 17, the arm section 23 of the fitting detection member 20 is disposed between the bifurcated protrusion pieces 18*a* and 18*a* of the operation section 18 in the regular locked position of the fitting detection member 20. As a result, as shown in FIGS. 15 and 16, a bending direction of the distal end portion 16*b* side of the lock arm 16 of the female housing 11 is opened, which allows the distal end portion 16*b* side of the lock arm 16 to be bent downward and deformed.

Figure 3:
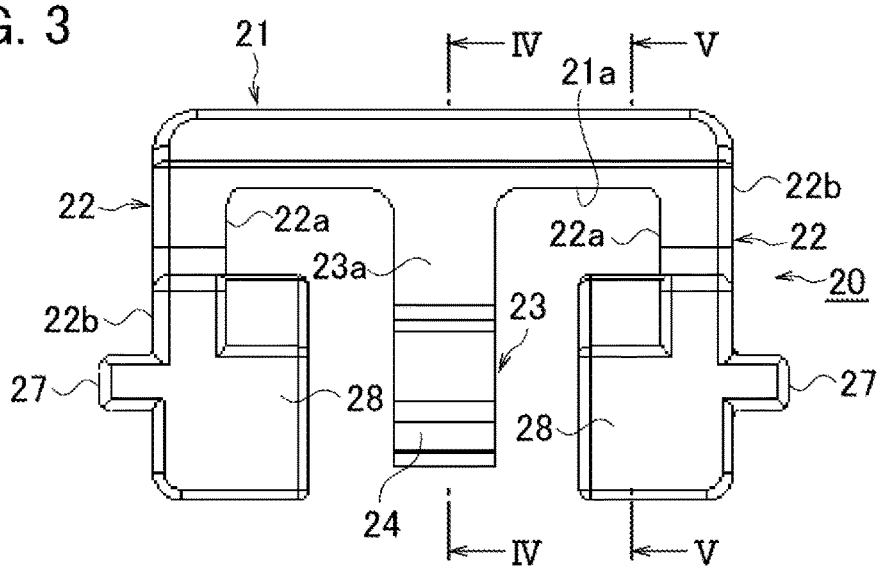
FIG. 3 is a front view of a fitting detection member of the connector.
Figure 4:
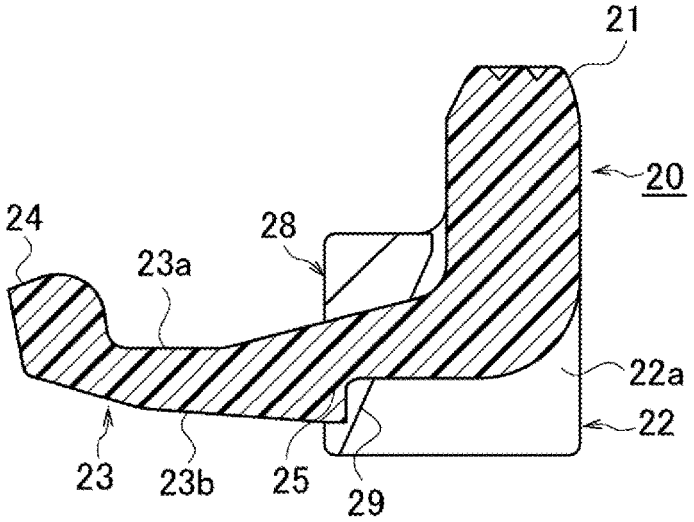
FIG. 4 is a sectional view taken along line IV-IV in FIG. 3.
Figure 5:
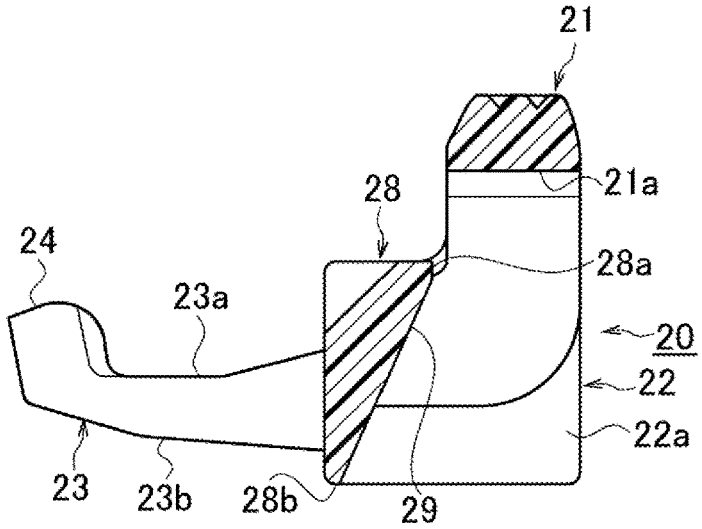
FIG. 5 is a sectional view taken along V-V line in FIG. 3.

As shown in FIGS. 3 to 5, the locking protrusion (locked portion) 24 which is locked to or detached from the locking hole 17*c* of the lock protrusion (lock section) 17 of the lock arm 16 is provided at the distal end of the flexible arm section 23. Further, the recessed slip-off prevention locking section 25 which is locked to or detached from the locking protrusion 14 of the CPA housing section 13 is provided at the center of the lower surface 23*b* of the flexible arm section 23.

As shown in FIGS. 3 to 5, a rail section 27, which is inserted into the recessed groove section 15 of the CPA housing section 13, protrudes from the respective lower sides of each outer surface 22*b* of the side sections 22 and 22 of the fitting detection member 20 so as to extend along the sliding direction. Further, the inclined surface (inclined section) 29 inclined obliquely to the front side of a lower surface 28*b* is provided on a rear surface 28*a* side (root side of flexible arm section 23) of a protrusion wall section 28 formed on each inner surface 22*a* side of the side sections 22 and 22 of the fitting detection member 20. Then, as shown in FIGS. 19 to 21B, in a case where the fitting of the female housing 11 is in the middle of being released from the male housing 31, the boss section 19 of the lock arm 16 slides downward along the inclined surface 29, so that the fitting detection member 20 can slide in a slip-off prevention direction L.

Figure 6:
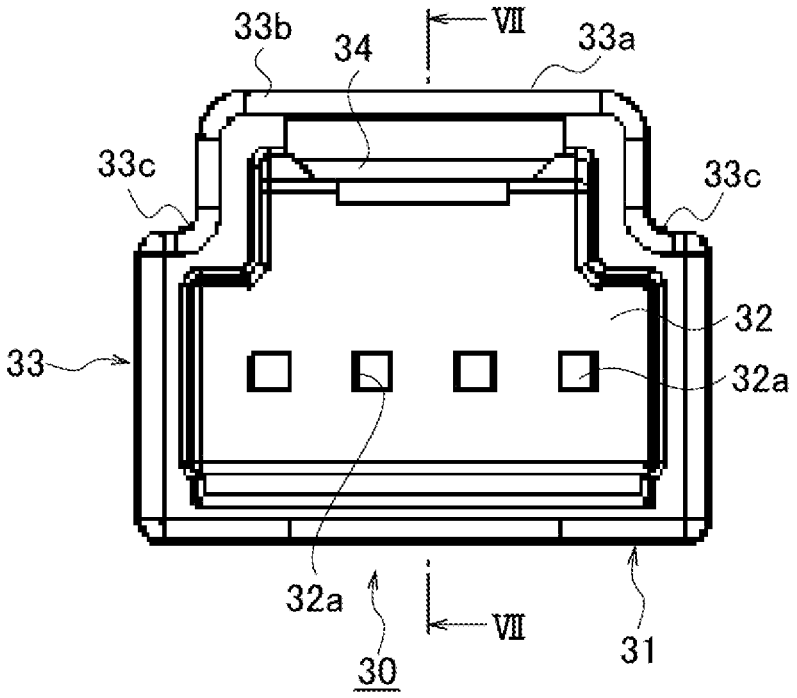
Figure 7:
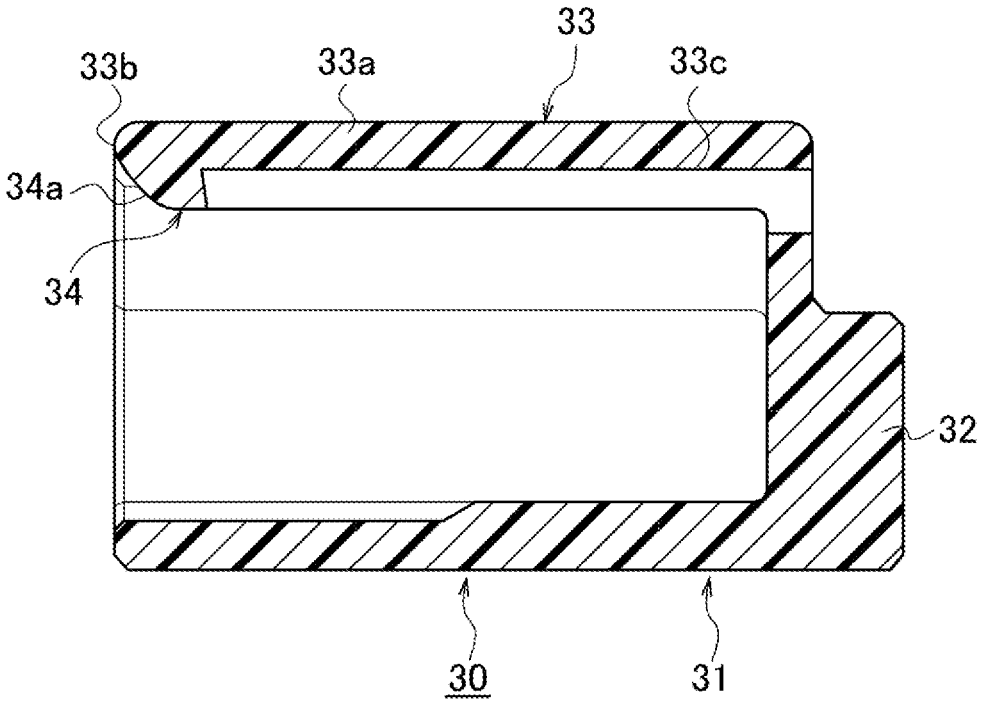
FIG. 7 is a sectional view taken along line in FIG. 6.
Figure 8:
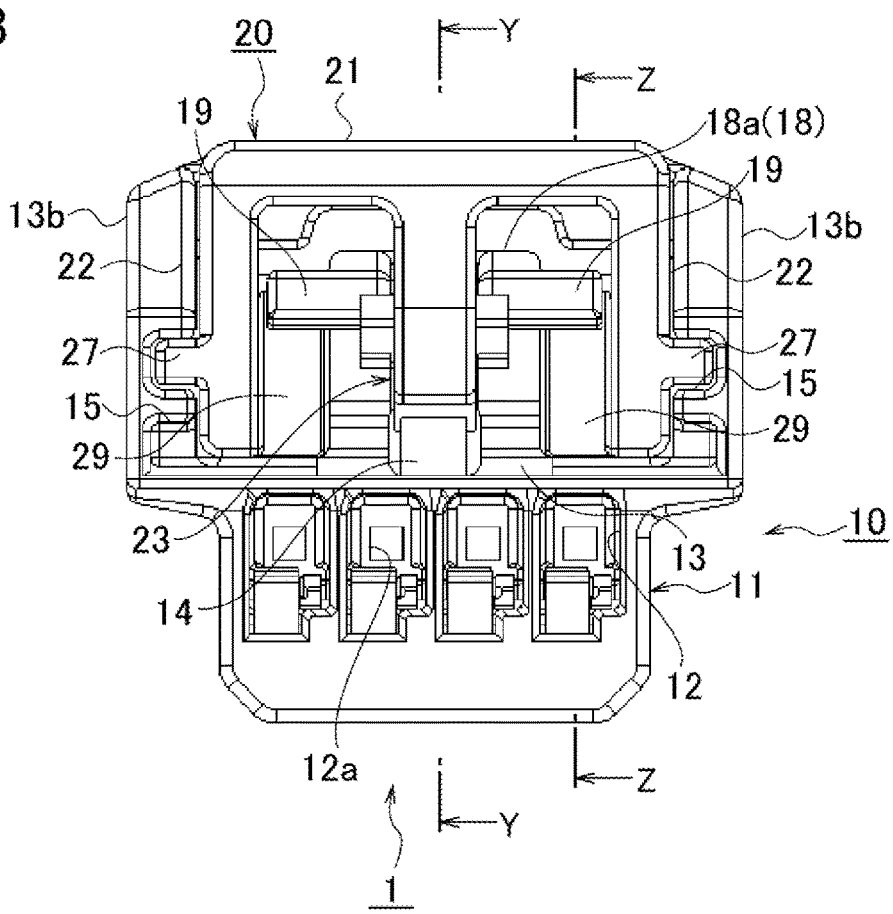
FIG. 8 is a front view of the connector before assembling of the fitting detection member.
Figure 19:
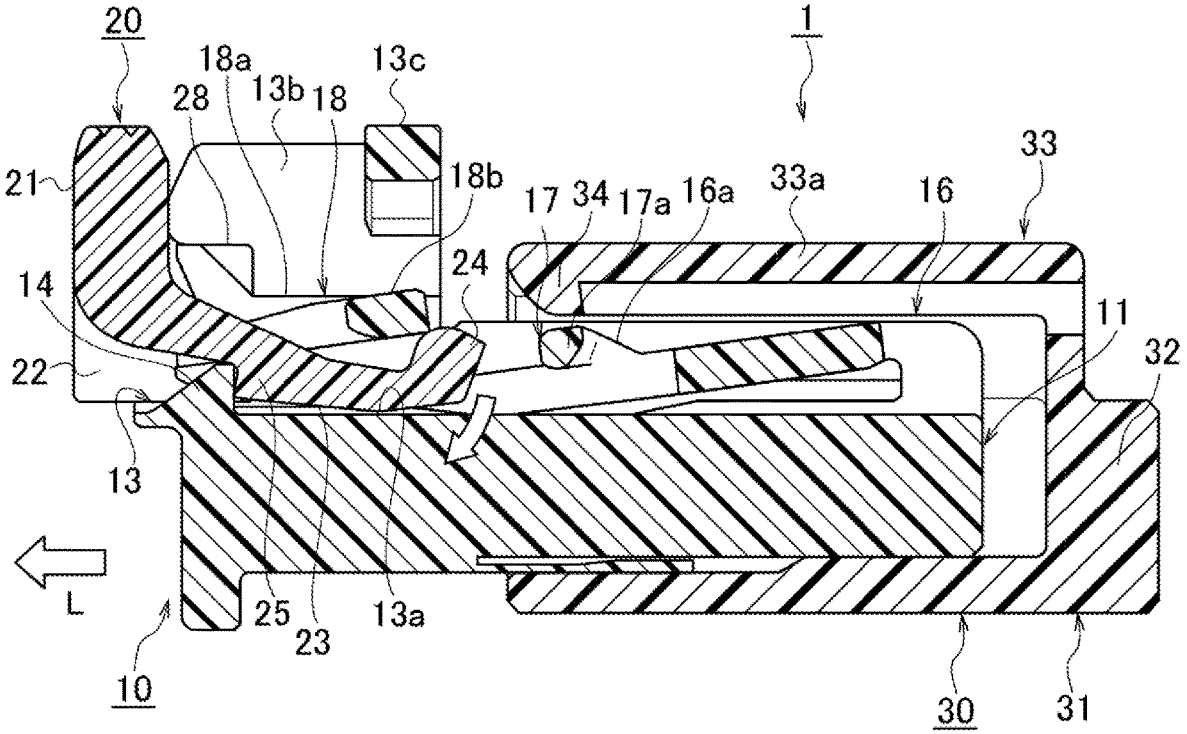
FIG. 19 is a sectional view taken along Y-Y line in FIG. 18 showing a halfway state of release of fitting of the female connector.

As shown in FIGS. 6 and 7, the male housing 31 includes a housing body 32 having a plurality of terminal housing holes 32*a* for housing male terminals (not shown), and a hood section 33 integrally protruded and formed on the front side of the housing body 32 and into which the female housing 11 is inserted and fitted. The hood section 33 is formed into a substantially square cylindrical shape and serves as a housing section for housing the front side to the intermediate side of the female housing 11. Further, the locking protrusion (locked section) 34 which is locked to or detached from the lock protrusion (lock section) 17 is provided on the inner surface of the front end 33*b* side of an upper wall 33*a* of the hood section 33. As shown in FIG. 15, when the female housing 11 is fitted into the hood section 33, the locking protrusion 24 of the arm section 23 of the fitting detection member 20 comes in contact with the locking protrusion 34, so that the locking protrusion 24 is pressed downward. As the locking protrusion 24 is pressed downward, the arm section 23 is bent downward and deformed (elastic deformation) and displaced. As shown in FIG. 19, when the fitting of the female housing 11 is released from the hood section 33, the lock protrusion 17 of the lock arm 16 comes in contact with the locking protrusion 34, so that the lock protrusion 17 is pressed downward. As the lock protrusion 17 is pressed downward, the distal end portion 16*b* side of the flexible lock arm 16 is bent downward and deformed (elastic deformation) and displaced.

Further, step sections 33*c* are provided on both sides of the upper wall 33*a* of the hood section 33 of the male housing 31, and the pair of side walls 13*d* and 13*d* of the female housing 11 are inserted between the pair of step sections 33*c* and 33*c*. The male terminals housed in and fixed to the terminal housing holes 32*a* of the housing body 32 of the male housing 31 are inserted into the terminal housing chamber 12 from the terminal inserting holes 12*a* of the female housing 11 and electrically connected to the female terminals. Further, the female terminals housed in the terminal housing chamber 12 of the female housing 11 are locked by a retainer flexible lance 12*b*.

Figure 9:
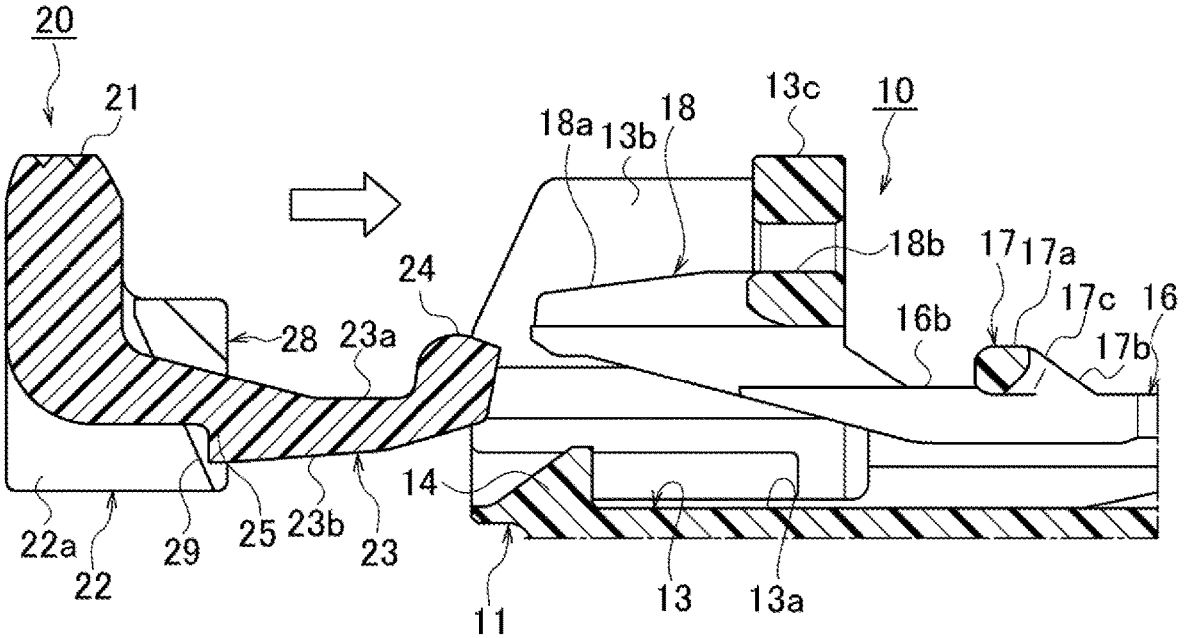
FIG. 9 is a partial sectional view taken along Y-Y line in FIG. 8 showing a state before assembling of the fitting detection member.
Figure 10:
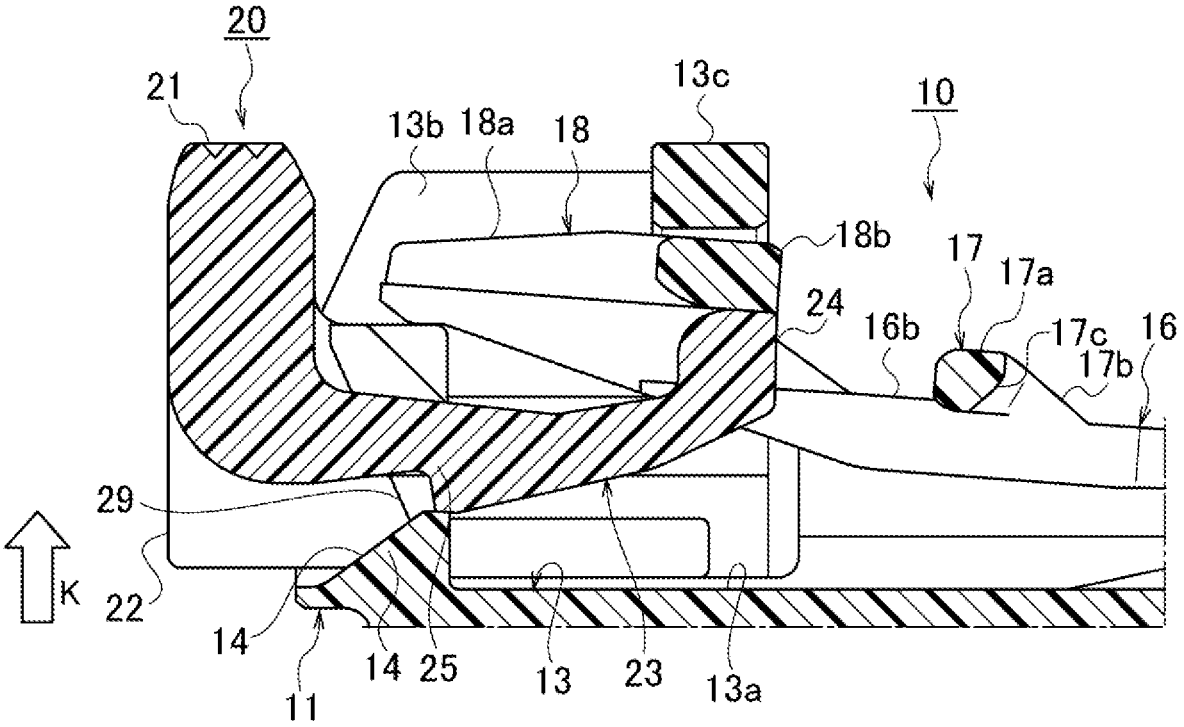
FIG. 10 is a partial sectional view taken along the Y-Y line in FIG. 8 showing a halfway state of assembling the fitting detection member.
Figure 11A:
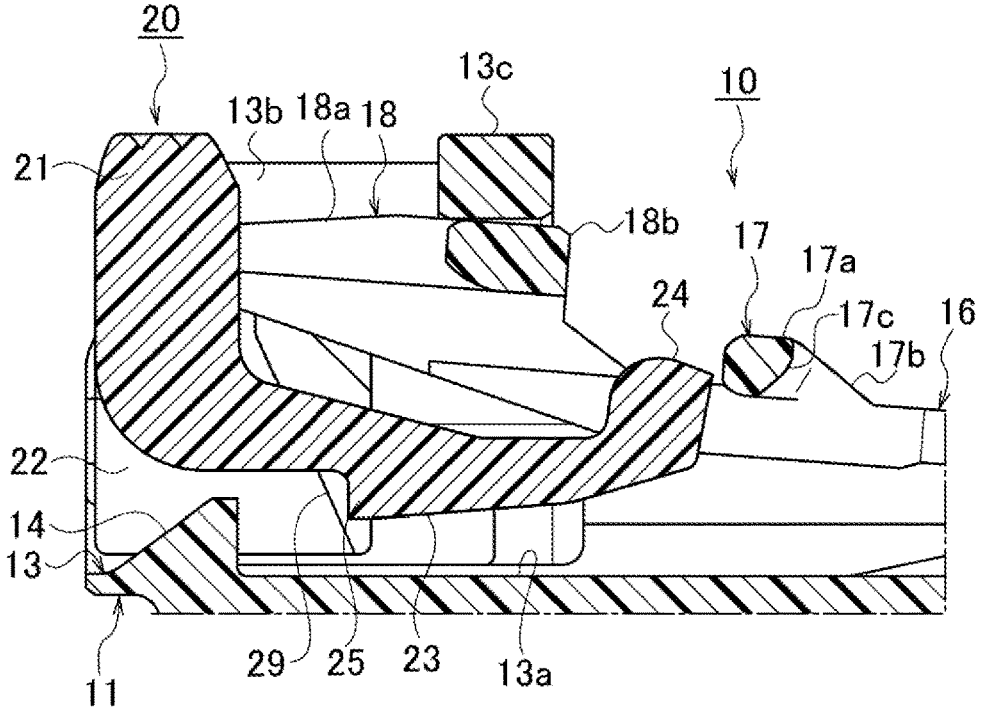
FIG. 11A is a partial sectional view taken along the Y-Y line in FIG. 8 showing a state immediately before assembling of the fitting detection member.
Figure 11B:
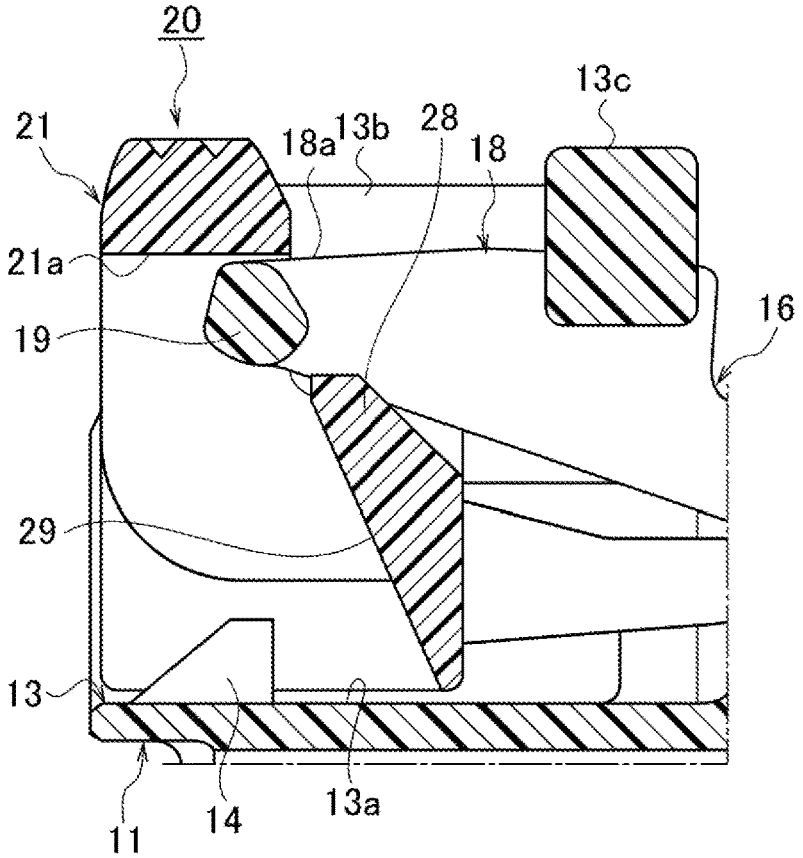
FIG. 11B is a partial sectional view taken along Z-Z line in FIG. 8 showing a state immediately before assembling of the fitting detection member.
Figure 12A:
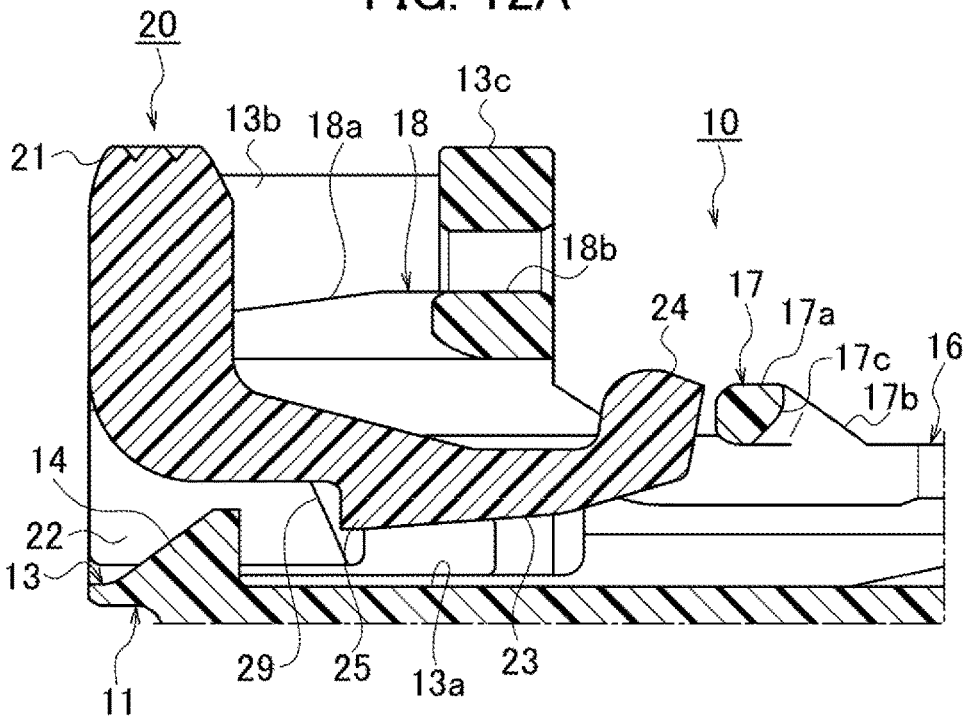
FIG. 12A is a partial sectional view taken along the Y-Y line in FIG. 8 showing a state in which assembling of the fitting detection member is completed.
Figure 12B:
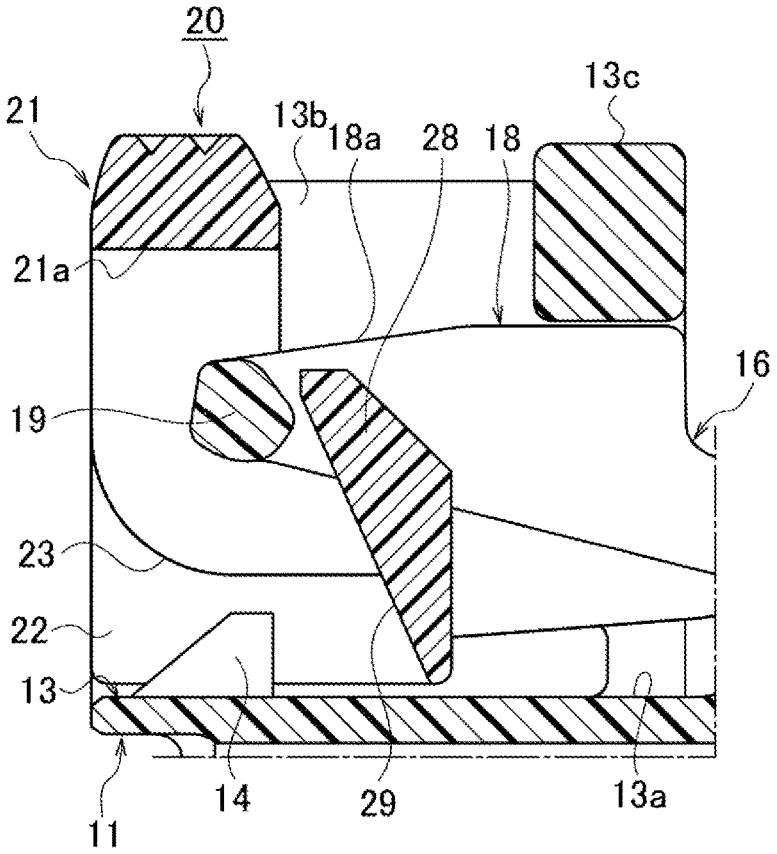
FIG. 12B is a partial sectional view taken along the Z-Z line in FIG. 8 showing a state in which assembling of the fitting detection member is completed.

When the connector 1 of the first embodiment is assembled, as shown in FIG. 9, the fitting detection member 20 is firstly inserted into the CPA housing section 13 of the female housing 11 and housed therein by a pressing operation of the operation section 21. When the fitting detection member 20 is housed in the CPA housing section 13, the slip-off prevention locking section 25 of the arm section 23 of the fitting detection member 20 comes in contact with the locking protrusion 14 of the CPA housing section 13, so that the locking protrusion 24 side of the arm section 23 is bent upward and deformed as shown by arrow K in FIG. 10. In accordance with the bending deformation of the arm section 23, the locking protrusion 24 of the arm section 23 presses the operation section 18 of the lock arm 16 of the female housing 11 upward, and as shown in FIGS. 11B and 12B, the boss sections 19 on both sides of the operation section 18 get over the protrusion wall section 28. Since the boss sections 19 get over the protrusion wall section 28, the fitting detection member 20 is temporarily locked. This temporary locked state is a temporary locked position of the fining detection member 20 shown in FIG. 13.

As shown in FIG. 13, in the temporary locked position of the fitting detection member 20, the fitting detection member 20 housed in the CPA housing section 13 of the female housing 11 is locked in the slip-off prevention direction L by the locking protrusion 14 of the CPA housing section 13 and the slip-off prevention locking section 25 of the arm section 23. Further, the locking protrusion 24 of the arm section 23 of the fitting detection member 20 comes in contact with the lock protrusion 17 of the lock arm 16 of the female housing 11, thereby being locked in the regular locking direction R.

As shown in FIG. 15, when the fitting detection member 20 is further inserted into the CPA housing section 13, the lock protrusion 17 of the lock arm 16 and the locking protrusion 24 of the arm section 23 are pushed downward by an inclined surface 34*a* of the locking protrusion 34 of the male housing 31, so that the temporary locked state is released.

When the female housing 11 is further inserted into the male housing 31 in a state in which the temporary locking of the fitting detection member 20 is released, as shown in FIG. 16, the locking section 17*a* of the lock protrusion 17 of the lock arm 16 is locked to the locking protrusion 34 of the male housing 31. This locked state is in a state of completion of fitting of both the male and female housings 11 and 31, so that the female housing 11 is locked in the slip-off prevention direction L. Then, as shown in FIG. 17, the locking protrusion 24 of the arm section 23 of the fitting detection member 20 is inserted into the locking hole 17*c* of the lock protrusion 17 of the lock arm 16 of the female housing 11 and locked thereto, so that the fitting detection member 20 is regularly locked. The regular locked state (regular locked position) of the fitting detection member 20 enables a proper fitting of both the male and female housings 11 and 31 to be detected.

Next, release of fitting of the male and female housings 11 and 31 (release of locking of the flexible lock arm 16) will be described.

Figure 20A:
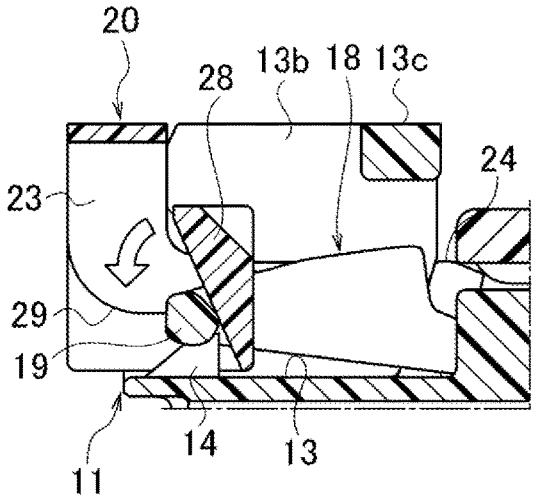
FIG. 20A is a partial sectional view taken along the Y-Y line in FIG. 18 showing a state immediately before release of fitting of the female connector.

As shown in FIG. 19, when the operation section 21 of the fitting detection member 20 is operated in the slip-off prevention direction L in the regular locked state of the fitting detection member 20, as shown in FIG. 20A, the boss section 19 provided on the operation section 18 of the lock arm 16 slides downward along the inclined surface 29 of the protrusion wall section 28. The lock arm 16 is bent downward and deformed by sliding of the boss section 19, so that the locking of the locking protrusion 34 of the male housing 31 and the lock protrusion 17 of the lock arm 16 of the female housing 11 is released. Thereafter, the fitting of the male housing 31 and the female housing 11 is released (detached) by pulling out the female housing 11 from the male housing 31.

Figure 20B:
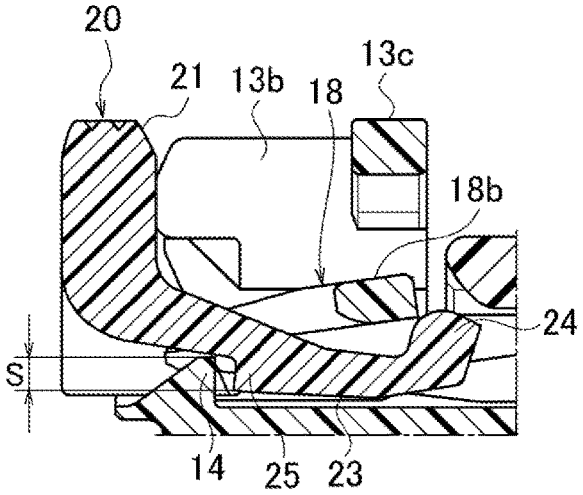
FIG. 20B is a partial sectional view taken along Z-Z line in FIG. 18 showing a state immediately before release of fitting of the female connector.
Figure 21A:
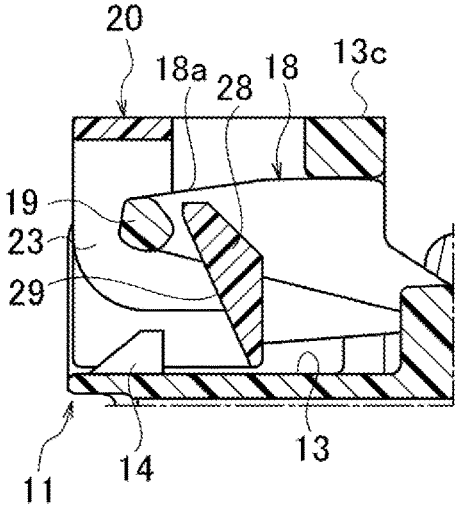
FIG. 21A is a partial sectional view taken along the Y-Y line in FIG. 18 showing a state in which release of fitting of the female connector is completed.
Figure 21B:
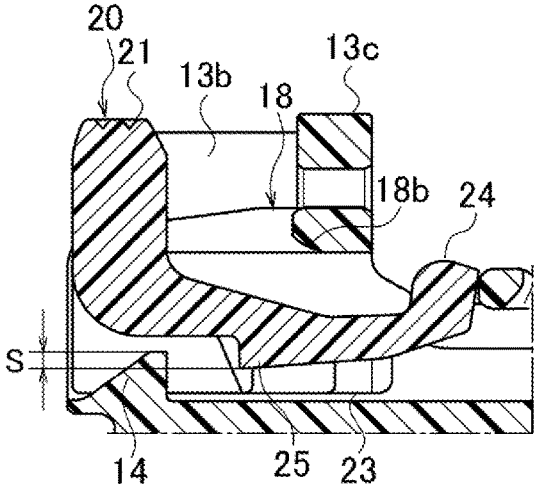
FIG. 21B is a partial sectional view taken along the Z-Z line in FIG. 18 showing a state in which release of fitting of the female connector is completed.
Figure 22A:
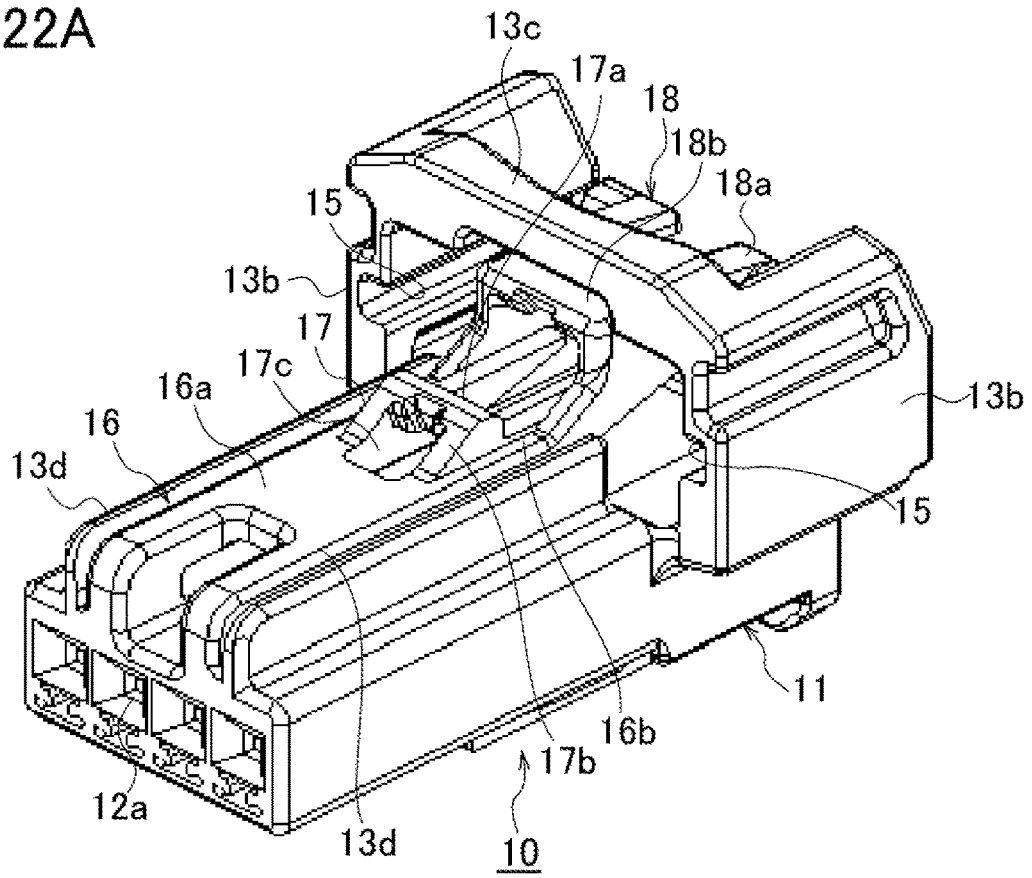
FIG. 22A is a perspective view of an example of a female connector of a connector according to a second embodiment of the present application as viewed from the rear side.
Figure 22B:
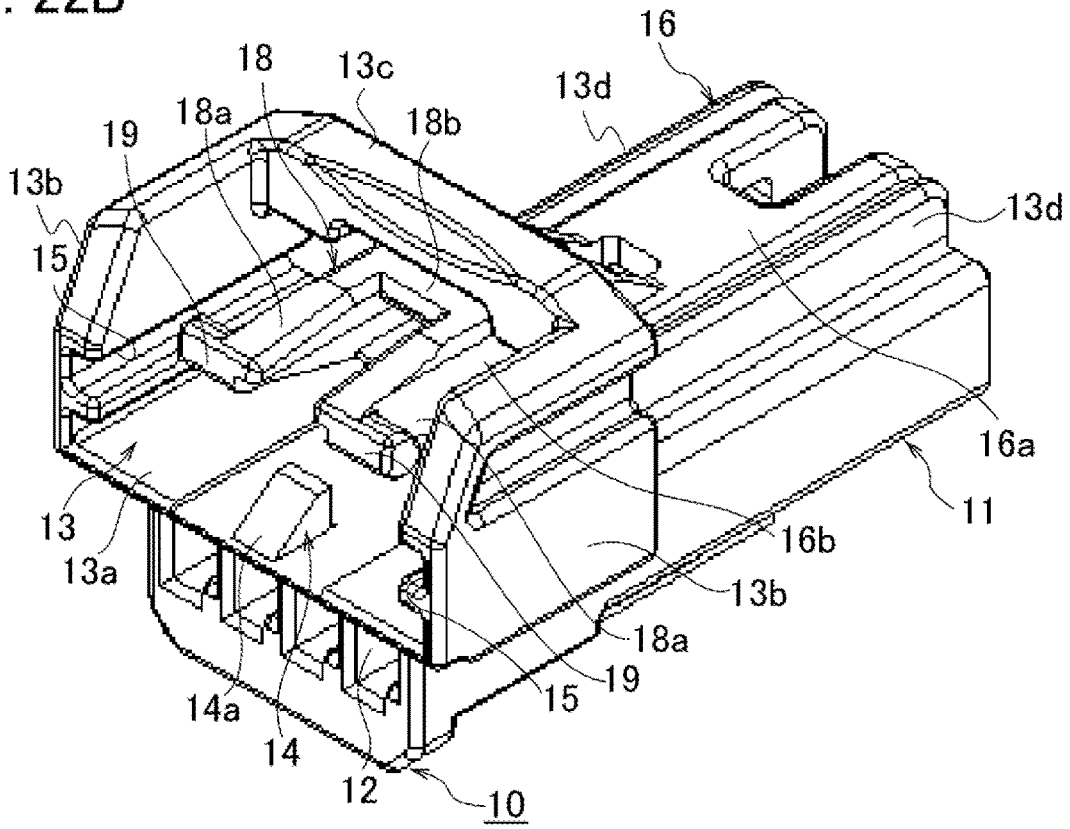
FIG. 22B is a perspective view of the female connector as viewed from the front side.
Figure 23:
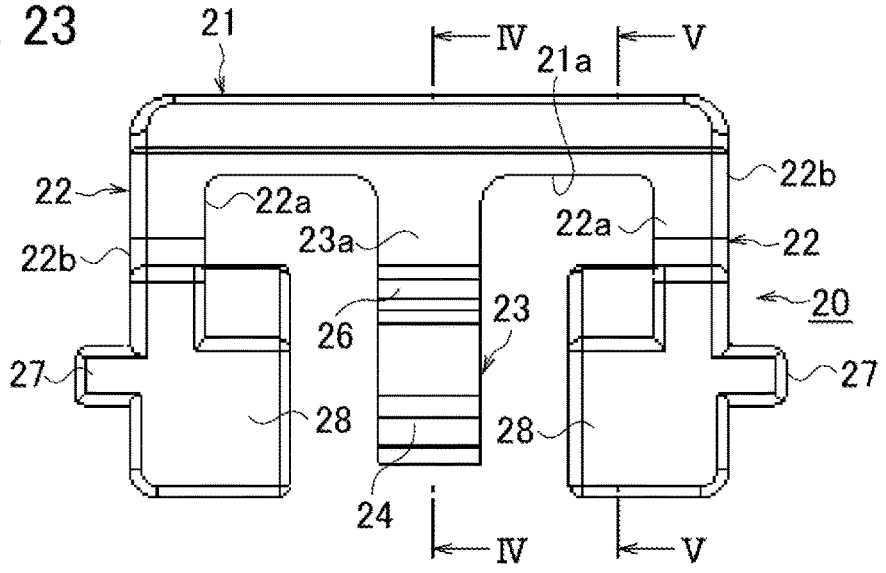
FIG. 23 is a front view of a fitting detection member of the connector according to the second embodiment.

Further, during the operation of the fitting detection member 20, the operation section 18 of the flexible lock arm 16 comes in contact with the locking protrusion 24 of the fitting detection member 20. As shown in FIG. 20B, this contact pushes the arm section 23 down, and a locking margin S between the slip-off prevention locking section 25 of the arm section 23 and the locking protrusion 14 of the CPA housing section 13 is made to be flexibly moved in the direction increasing from a locking margin S shown in FIG. 21B. In this way, when the fitting of the male housing 31 and female housing 11 is released (detached), the arm section 23 is bent downward and deformed in the direction in which the locking margin S between the locking protrusion 14 of the fitting detection member 20 and the slip-off prevention locking section 25 of the arm section 23 increases, so that a holding force of the fitting detection member 20 is expected to be improved. That is, by increasing the locking margin S between the locking protrusion 14 of the CPA housing section 13 of the female housing 11 and the slip-off prevention locking section 25 of the flexible arm section 23 of the fitting detection member 20, it is possible to prevent the fitting detection member 20 coming off from the CPA housing section 13 of the female housing 11 at the time of release of fitting.

The connector 1 according to the second embodiment is different from the connector 1 according to the first embodiment in that, in the regular locked position of the fitting detection member 20, the step section 26 for controlling the displacement of the flexible lock arm 16 is provided on the rear side (root side) from the position of the slip-off prevention locking section 25 on the upper side of the flexible arm section 23 (opposite surface of the slip-off prevention locking section 25). Since the other components are the same as those of the first embodiment, the same components are denoted by the same reference numerals and the detailed description thereof is omitted.

Figure 24:
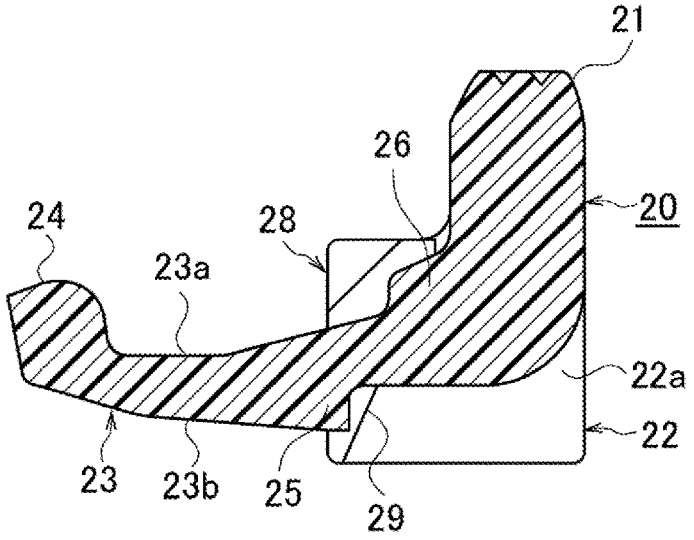
FIG. 24 is a sectional view taken along line IV-IV in FIG. 23.
Figure 25:
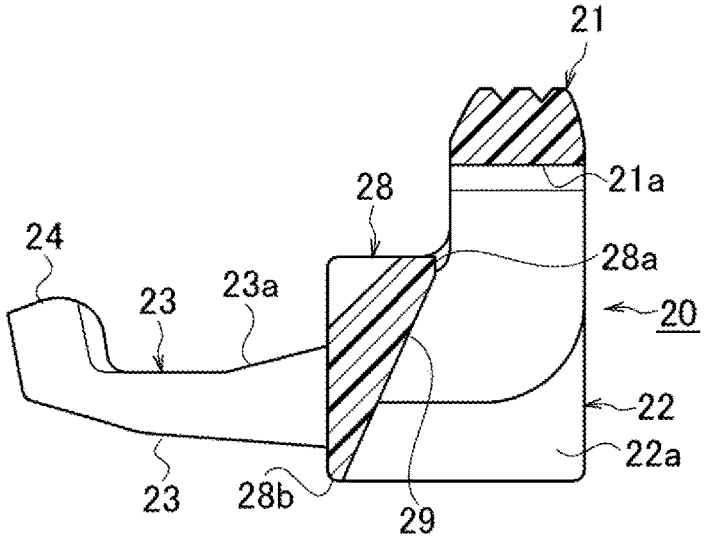
FIG. 25 is a sectional view taken along V-V line in FIG. 23.
Figure 26:
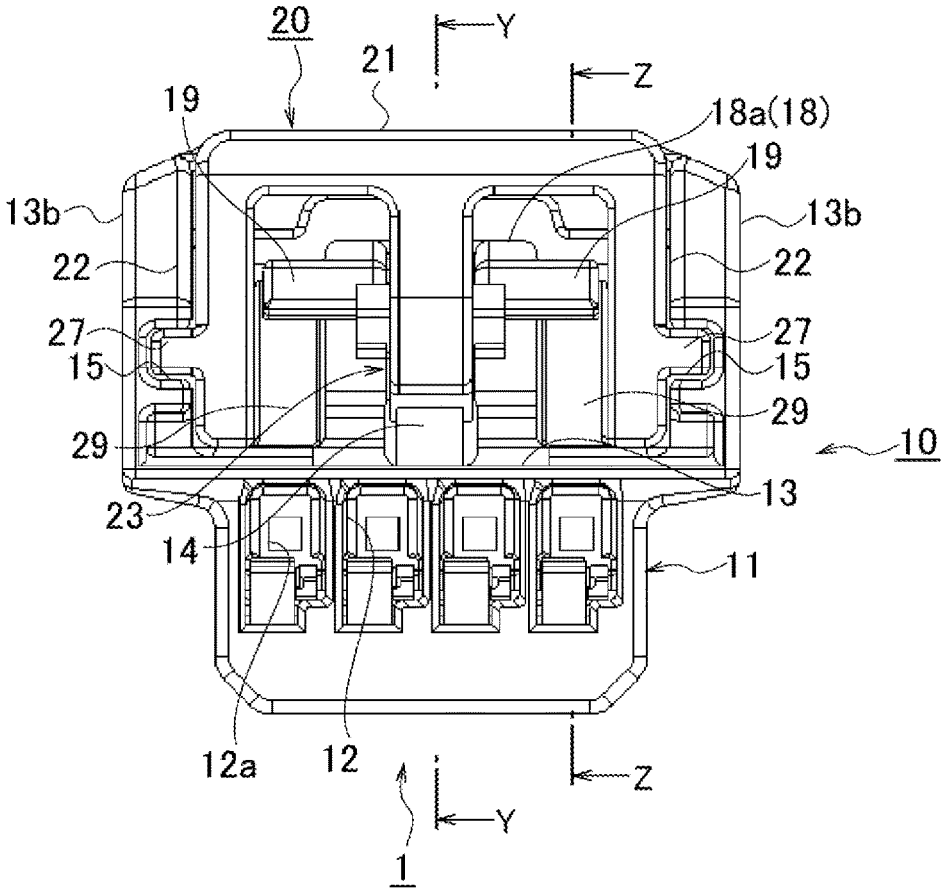
FIG. 26 is a front view of the connector when the fitting detection member of the second embodiment is assembled.

That is, in the fitting detection member 20 of the second embodiment, as shown in FIG. 24, the step section 26 protrudes from the upper side of an upper surface 23*a* of the flexible arm section 23. As a result, in the regular locked position of the fitting detection member 20 shown in FIG. 37, the step section 26 of the arm section 23 moves to a position where the step section 26 enters under a portion of the bridge-like central section 18*b* of the operation section 18 of the lock arm 16, thereby controlling the position of the lock arm 16.

Figure 27:
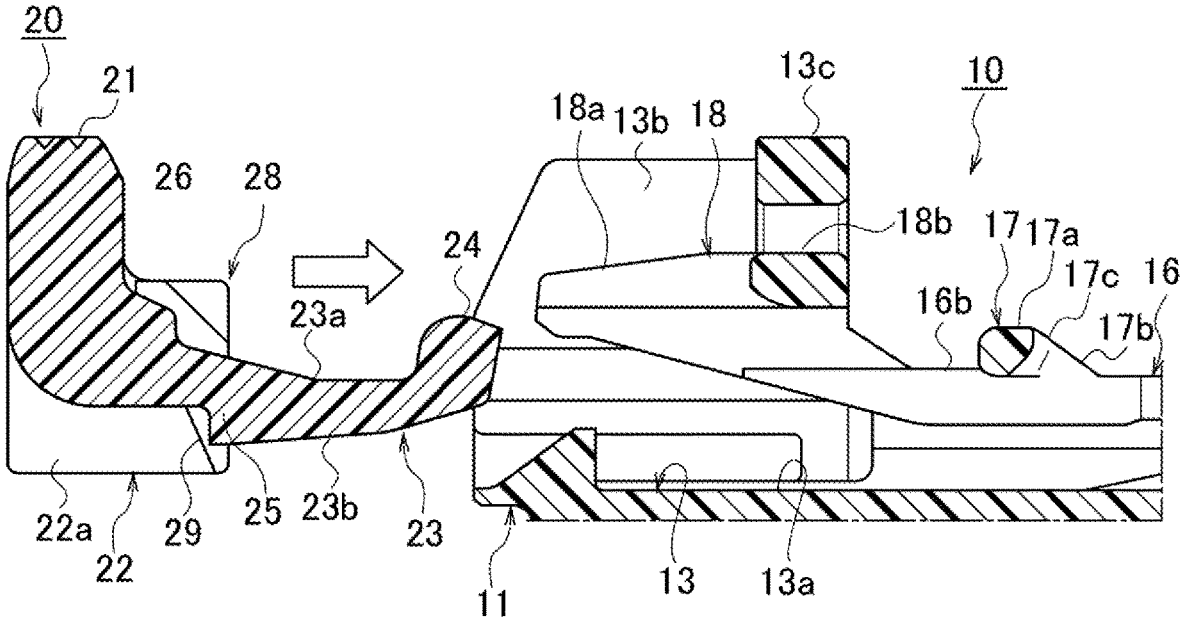
FIG. 27 is a partial sectional view taken along the Y-Y line in FIG. 8 showing a state before assembling of the fitting detection member of the second embodiment.
Figure 28:
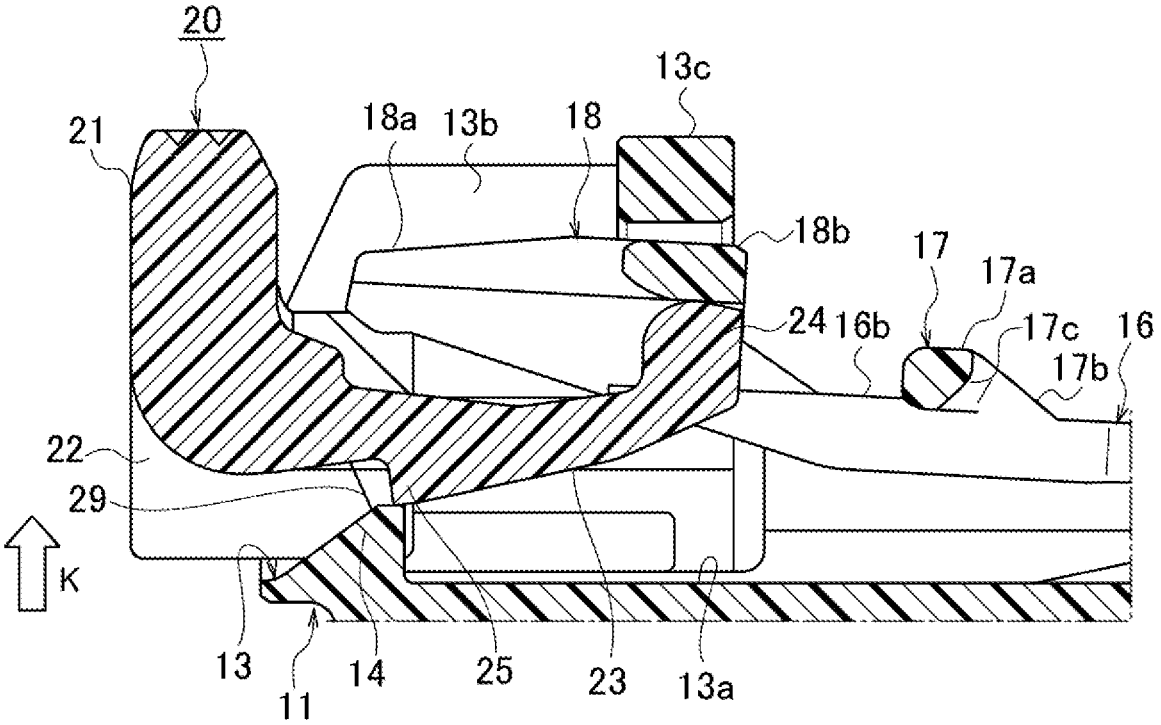
FIG. 28 is a partial sectional view taken along Y-Y line in FIG. 26 showing a halfway state of assembling the fitting detection member.
Figure 29A:
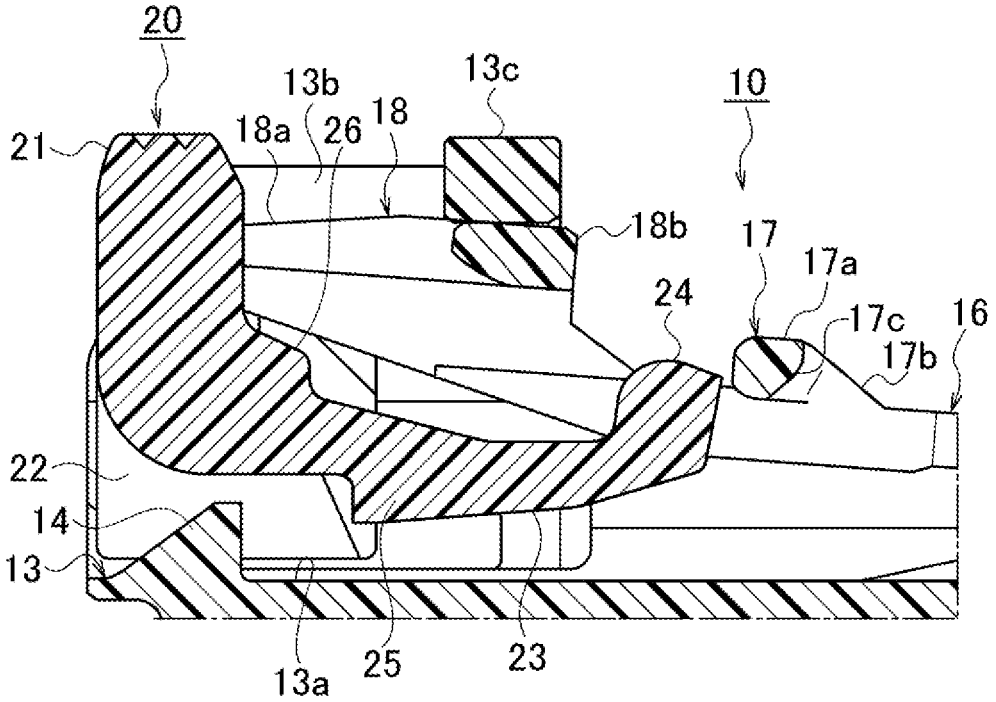
FIG. 29A is a partial sectional view taken along the Y-Y line in FIG. 26 showing a state immediately before assembling of the fitting detection member of the second embodiment.
Figure 29B:
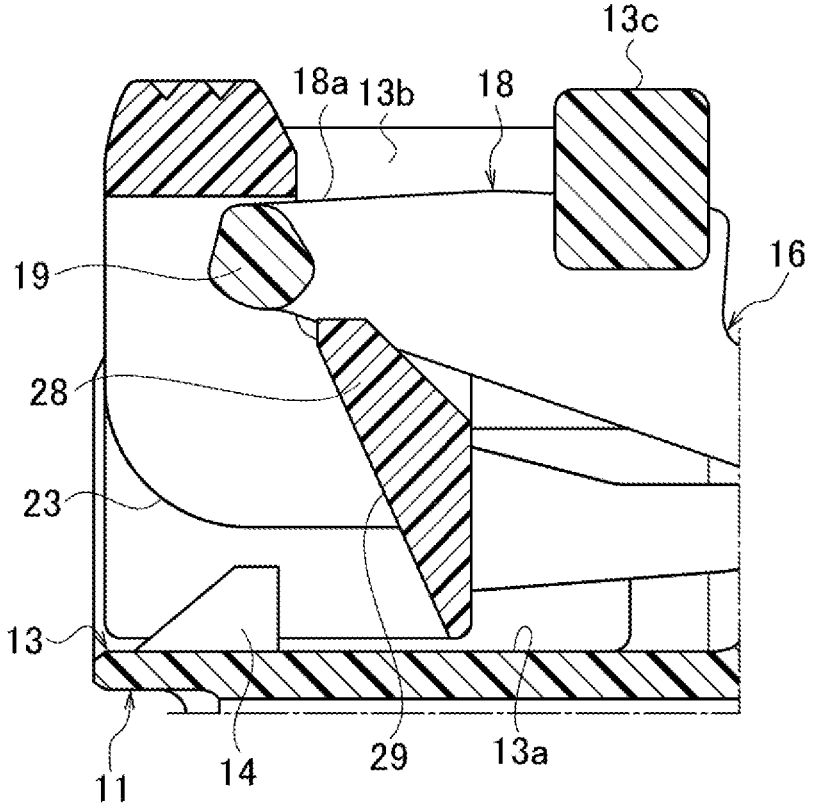
FIG. 29B is a partial sectional view taken along Z-Z line in FIG. 26 showing a state immediately before assembling of the fitting detection member.
Figure 30A:
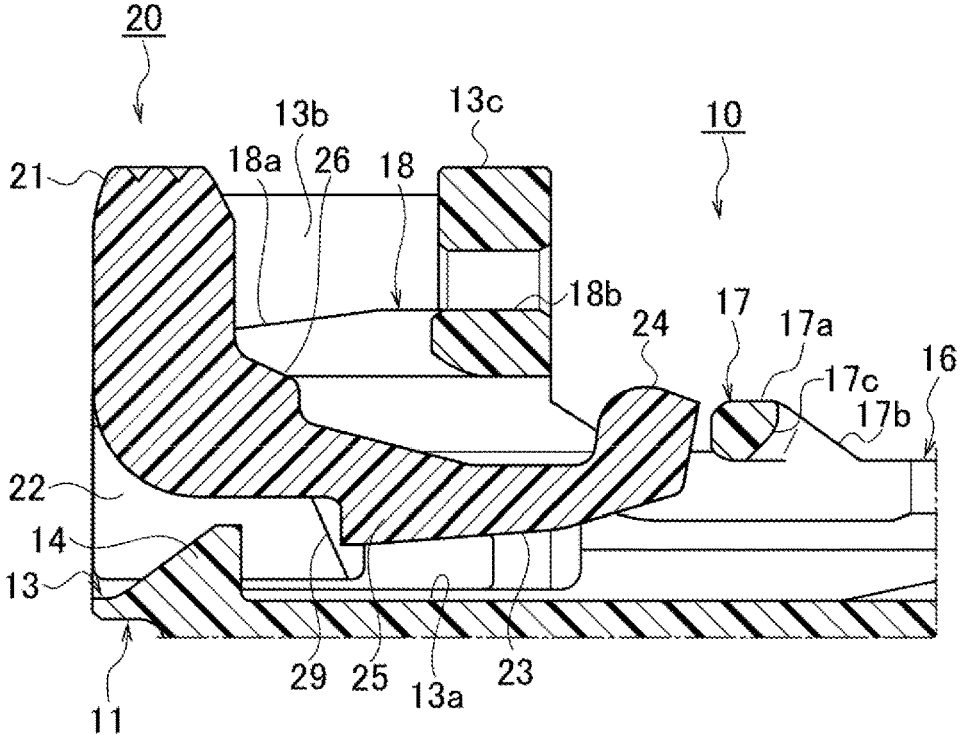
FIG. 30A is a partial sectional view taken along the Y-Y line in FIG. 26 showing a state in which assembling of the fitting detection member of the second embodiment is completed.
Figure 30B:
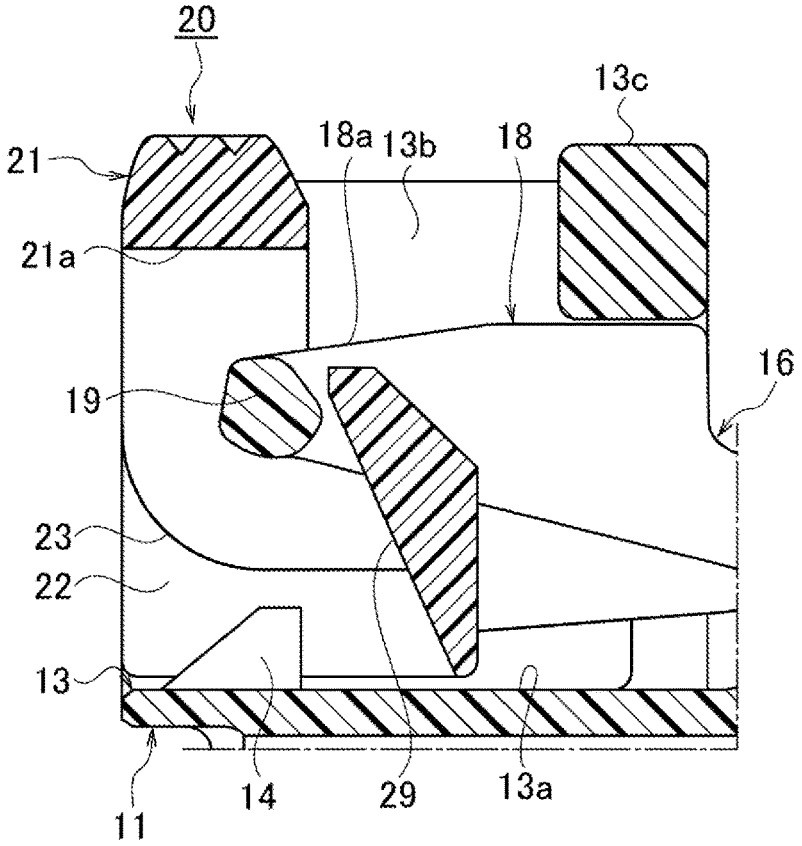
FIG. 30B is a partial sectional view taken along the Z-Z line in FIG. 26 showing a state in which assembling of the fitting detection member is completed.
Figure 31:
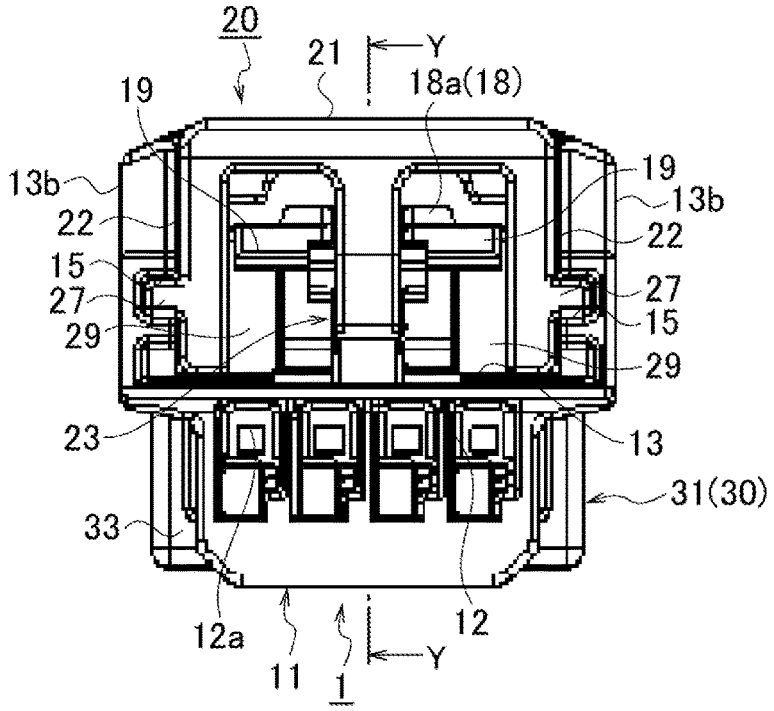
FIG. 31 is a front view of the connector in which the fitting detection member of the second embodiment is in a temporary locked state.

When the connector 1 of the second embodiment is assembled, as shown in FIG. 27, the fitting detection member 20 is firstly inserted into the CPA housing section 13 of the female housing 11 and housed therein by a pressing operation of the operation section 21. When the fitting detection member 20 is housed in the CPA housing section 13, the slip-off prevention locking section 25 of the arm section 23 of the fitting detection member 20 comes in contact with the locking protrusion 14 of the CPA housing section 13, so that the locking protrusion 24 side of the arm section 23 is bent upward and deformed as shown by arrow K in FIG. 28. In accordance with the bending deformation of the arm section 23, the locking protrusion 24 of the arm section 23 presses the operation section 18 of the lock arm 16 of the female housing 11 upward, and as shown in FIGS. 29B and 30B, the boss sections 19 on both sides of the operation section 18 get over the protrusion wall section 28. The boss sections 19 get over the protrusion wall section 28, so that the fitting detection member 20 is temporarily locked. This temporary locked state is a temporary locked position of the fitting detection member 20 shown in FIG. 32.

Figure 32:
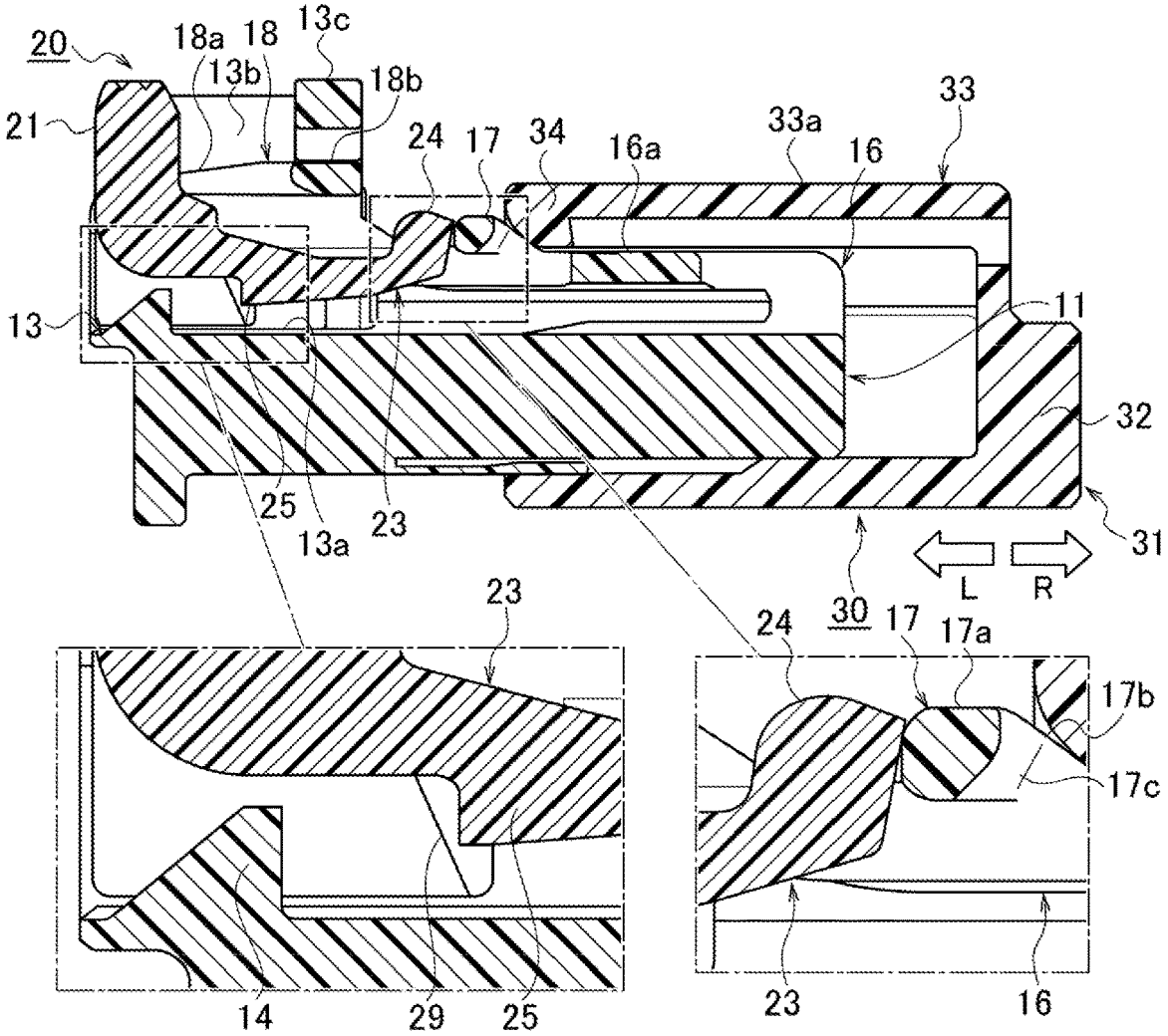
FIG. 32 is a sectional view taken along Y-Y line in FIG. 31 showing a temporary locked state of the fitting detection member of the second embodiment.

As shown in FIG. 32, in the temporary locked position of the fitting detection member 20, the fitting detection member 20 housed in the CPA housing section 13 of the female housing 11 is locked in the slip-off prevention direction L by the locking protrusion 14 of the CPA housing section 13 and the slip-off prevention locking section 25 of the arm section 23. Further, the locking protrusion 24 of the arm section 23 of the fitting detection member 20 comes in contact with the lock protrusion 17 of the lock arm 16 of the female housing 11, thereby being locked in the regular locking direction R.

Figure 33:
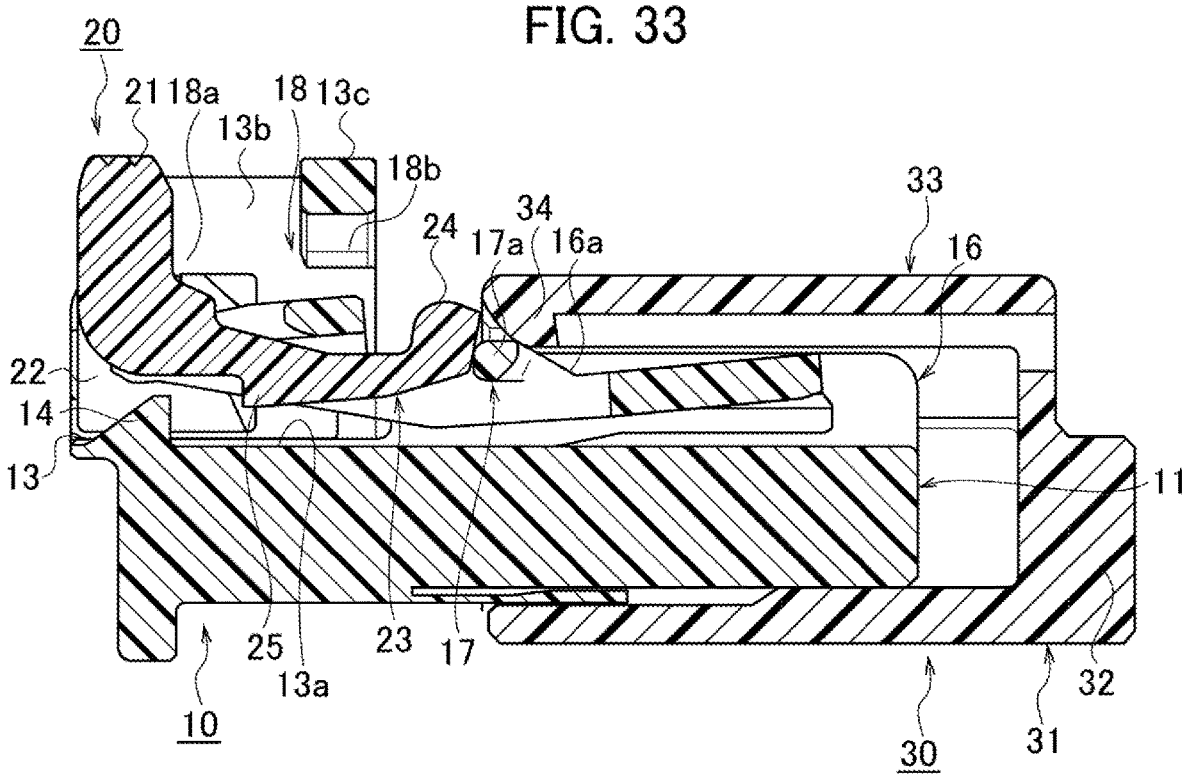
FIG. 33 is a sectional view taken along the Y-Y line in FIG. 31 showing a state of releasing a temporary locked state of the fitting detection member of the second embodiment.
Figure 34:
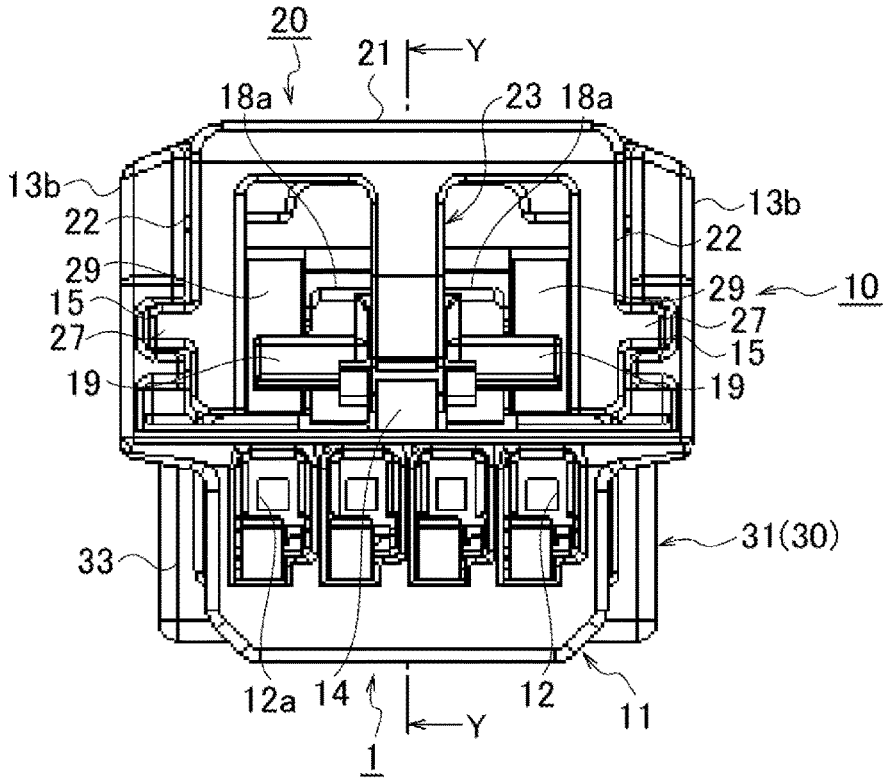
FIG. 34 is a front view of the connector before fitting of the female connector of the second embodiment.
Figure 35:
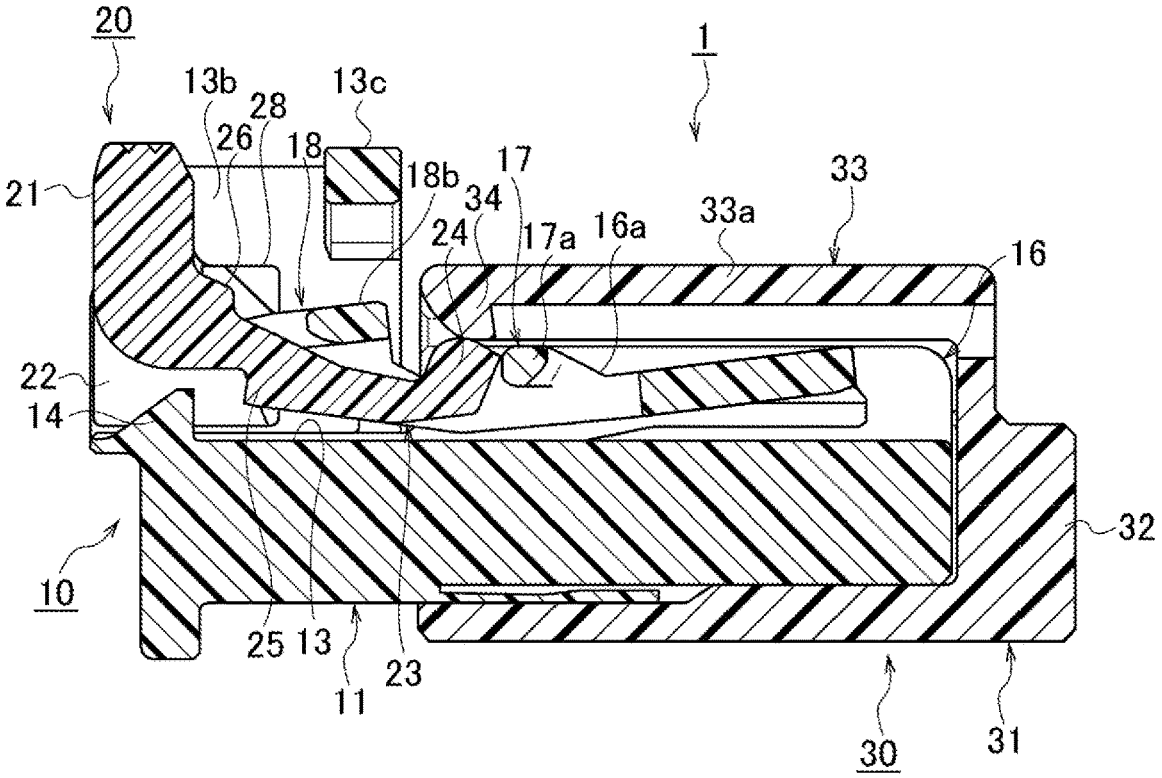
FIG. 35 is a sectional view taken along Y-Y line in FIG. 34 showing a halfway state of fitting of the female connector of the second embodiment.

As shown in FIG. 33, when the fitting detection member 20 is further inserted into the CPA housing section 13, the lock protrusion 17 of the lock arm 16 and the locking protrusion 24 of the arm section 23 are pushed downward by an inclined surface 34*a* of the locking protrusion 34 of the male housing 31, so that the temporary locked state is released.

Figure 36:
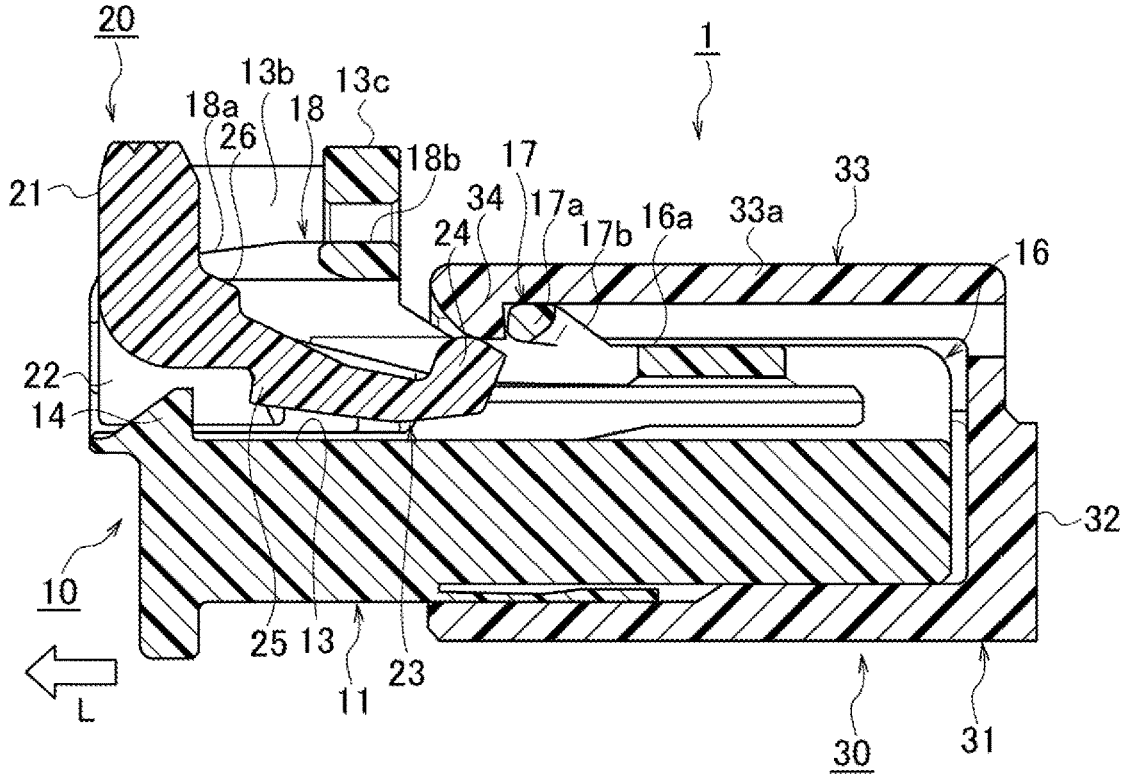
FIG. 36 is a sectional view taken along the Y-Y line in FIG. 34 showing a state of completion of fitting of the female connector of the second embodiment.
Figure 37:
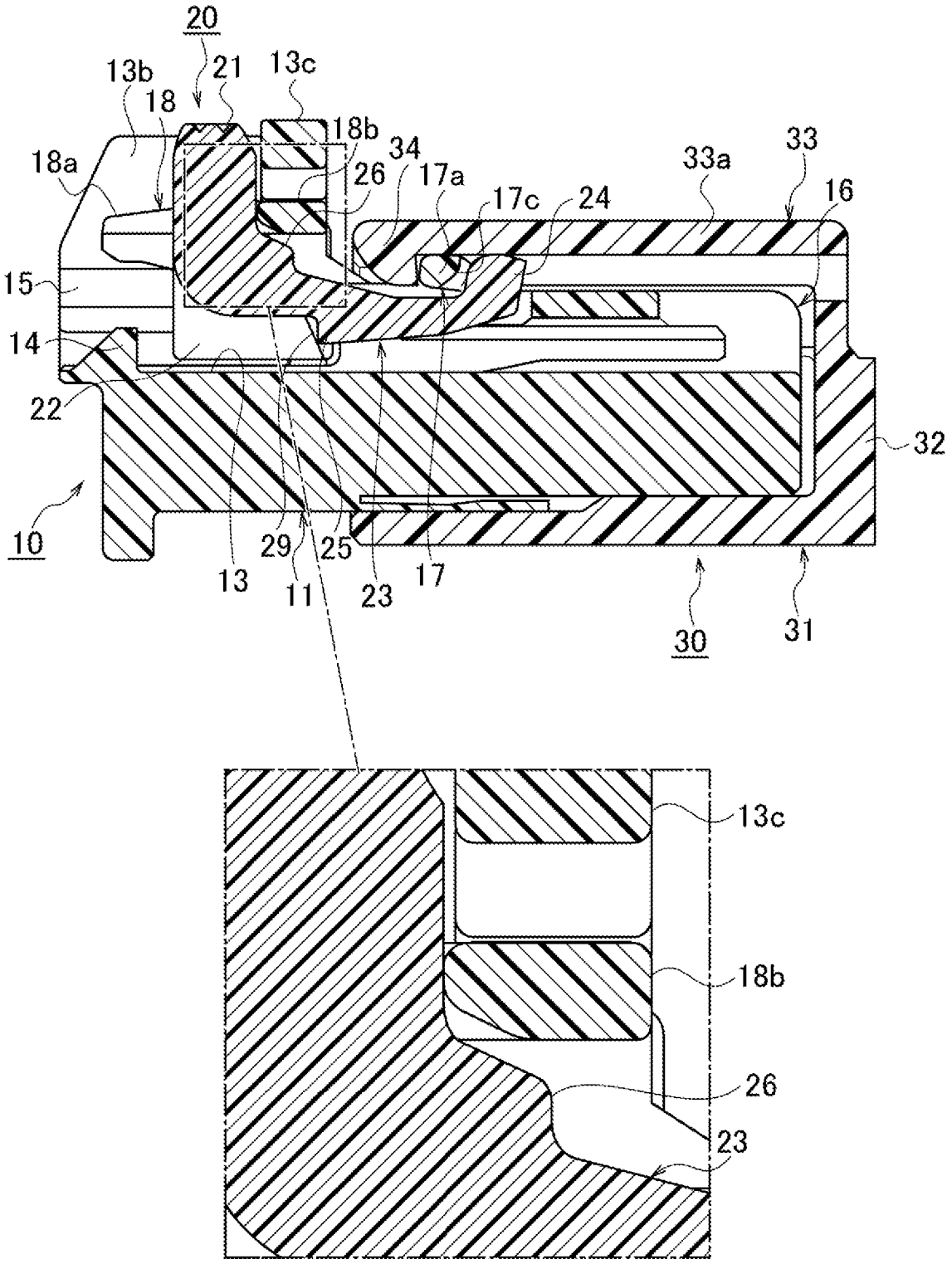
FIG. 37 is a sectional view taken along the Y-Y line in FIG. 34 showing a regular locked state of the fitting detection member of the second embodiment.

When the female housing 11 is further inserted into the male housing 31 in a state in which the temporary locking of the fitting detection member 20 is released, as shown in FIG. 36, the locking section 17*a* of the lock protrusion 17 of the lock arm 16 is locked to the locking protrusion 34 of the male housing 31. This locked state is in a state of completion of fitting of both the male and female housings 11 and 31, so that the female housing 11 is locked in the slip-off prevention direction L. Then, as shown in FIG. 37, the locking protrusion 24 of the arm section 23 of the fitting detection member 20 is inserted into the locking hole 17*c* of the lock protrusion 17 of the lock arm 16 of the female housing 11 and locked thereto, so that the fitting detection member 20 is regularly locked. The regular locked state (regular locked position) of the fitting detection member 20 enables a proper fitting of both the male and female housings 11 and 31 to be detected.

Further, as shown in FIG. 37, in the regular locked position of the fitting detection member 20, the step section 26 of the arm section 23 moves to a position where the step section 26 enters under the central section 18*b* of the operation section 18 of the lock arm 16, thereby controlling the position of the lock arm 16 and preventing the lock arm 16 from being displaced. Further, since the recessed slip-off prevention locking section 25 of the fitting detection member 20 detached from the locking protrusion 14 of the CPA housing section 13 is provided at the more flexible part on the distal end side of the arm section 23 than the step section 26, an assembling force can be reduced when the fitting detection member 20 is locked to the female housing 11.

Next, a comparative example of the present application will be described. A connector according to the comparative example includes a connector housing, and a fitting detection member which comes in contact with a contacted section of the connector housing before being fitted into a mating connector and, after being fitted into the mating connector, detects fitting by releasing the contact with the contacted section using the mating connector and further entering therein.

In the connector according to the comparative example, when the connector housing is detached (release of fitting) from the mating connector, the protrusion of the fitting detection member is locked to the protrusion of the connector housing, thereby preventing the fitting detection member from coming off the connector housing.

However, in the connector according to the comparative example, when the mating connector is detached from the connector housing (release of fitting), a locking margin of the protrusion of the fitting detection member does not increase, so that a holding force generated from locking of the fitting detection member and the connector housing is insufficient. As a result, there is a concern that the fitting detection member may come off.

Although the present embodiment has been described above, the present embodiment is not limited thereto, and various modifications can be made within a scope of the gist of the present embodiment.

That is, according to each of the embodiments, the rail section of the fitting detection member is simply inserted into the recessed groove section of the female housing, but the rail section of the fitting detection member may be provided with an engagement protrusion and the recessed groove section of the female housing may be provided with a locking convex section. In this case, when the fitting detection member is pushed in the regular locking direction, the engagement protrusion of the rail section is locked to the locking convex section of the groove section, so that a regular locked state of the fitting detection member is completed. As a result, this completion state enables a normal fitting state of both the male and female housings to be reliably detected.

While certain embodiments have been described, these embodiments have been presented by way of example only, and are not intended to limit the scope of the inventions. Indeed, the novel embodiments described herein may be embodied in a variety of other forms, furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connector comprising:

a mating housing including a locked section;

a housing fitted into or detached from the mating housing; and a fitting detection member assembled to the mating housing and movable between a temporary locked position and a regular locked position when the mating housing and the housing are fitted, wherein:

the housing includes a member housing section configured to house the fitting detection member, a lock section locked to or detached from the locked section of the mating housing, and a flexible lock arm having locking release sections each of which is configured to slide along an inclined section of the fitting detection member and to release a locked state of the lock section and the locked section, the fitting detection member includes a locked portion locked to or detached from the lock section of the flexible lock arm, and a flexible arm section provided with a slip-off prevention locking section locked to or detached from a locking protrusion of the member housing section, and when fitting of the mating housing and the housing is released, the flexible arm section is bent and deformed in a direction in which a locking margin between the locking protrusion of the member housing section and the slip-off prevention locking section of the flexible arm section increases.

2. The connector according to claim 1, wherein:

a state in which the locked portion of the flexible arm section of the fitting detection member is brought into contact with the lock section of the flexible lock arm by assembling the fitting detection member to the housing is a temporary locked state of the fitting detection member, the flexible arm section of the fitting detection member and the flexible lock arm are bent and deformed by the locked section of the mating housing to release the temporary locked state of the fitting detection member due to the contact between the lock section of the flexible lock arm and the locked portion of the flexible arm section of the fitting detection member, and the locked portion of the flexible arm section is locked to a locking hole of the lock section of the flexible lock arm, thereby bringing the fitting detection member into a regular locked state which is a proper fitting state of both the housings.

3. The connector according to claim 1, wherein, in a regular locked position of the fitting detection member, a step section configured to control a displacement of the flexible lock arm is provided on a root side of the flexible arm section from a position of the slip-off prevention locking section on an upper side of the flexible arm section.

4. The connector according to claim 3, wherein, in a regular locked position of the fitting detection member, the step section of the flexible arm section enters under a portion of an operation section provided at a distal end portion of the flexible lock arm and comes in contact therewith, thereby controlling a displacement of the flexible lock arm.

5. The connector according to claim 1, wherein:

the fitting detection member includes an operation section as a main body, side sections provided on both end sides of the operation section and the flexible arm section provided between the side sections, the locked portion is provided at a distal end of the flexible arm section, an inclined surface serving as the inclined section is provided at a root side of the flexible arm section of a protrusion wall section formed on each inner surface side of the side sections, and a rail section, which is inserted into a groove section formed in a member housing section of the housing, protrudes from each outer surface of the side sections along a sliding direction.

* * * * *